US006722255B2

(12) United States Patent
Herring

(10) Patent No.: US 6,722,255 B2
(45) Date of Patent: Apr. 20, 2004

(54) APPARATUS AND METHOD FOR ACTUATING A BOLT CARRIER GROUP OF A RECEIVER ASSEMBLY

(76) Inventor: Geoffrey A. Herring, P.O. Box 10667, Blacksburg, VA (US) 24062

( * ) Notice: Subject to any disclaimer, the term of this patent is extended or adjusted under 35 U.S.C. 154(b) by 0 days.

(21) Appl. No.: 10/301,150

(22) Filed: Nov. 21, 2002

(65) Prior Publication Data

US 2003/0126781 A1 Jul. 10, 2003

Related U.S. Application Data

(62) Division of application No. 09/734,279, filed on Dec. 11, 2000.

(51) Int. Cl.[7] ..... F41A 5/18
(52) U.S. Cl. ..... 89/193; 89/191.01
(58) Field of Search ..... 89/191.01, 191.02, 89/192, 193

(56) References Cited

U.S. PATENT DOCUMENTS

| | | | | | |
|---|---|---|---|---|---|
| 1,738,501 | A | * | 12/1929 | Moore | 89/193 |
| 2,058,897 | A | * | 10/1936 | Marek | 89/193 |
| 2,383,487 | A | | 7/1945 | Johnson | |
| 2,457,835 | A | * | 1/1949 | Schiff | 89/152 |
| 2,792,761 | A | | 5/1957 | Stoner | |
| 2,865,256 | A | * | 12/1958 | Marsh | 89/191.02 |
| 2,951,424 | A | | 8/1960 | Stoner | |
| 3,035,495 | A | | 5/1962 | Stoner | |
| 3,045,555 | A | | 7/1962 | Stoner | |
| 3,198,076 | A | | 8/1965 | Stoner | |
| 3,207,036 | A | * | 9/1965 | Norton | 89/191.01 |
| 3,246,567 | A | * | 4/1966 | Miller | 89/191.02 |
| 3,318,192 | A | | 5/1967 | Miller et al. | |
| 3,580,132 | A | * | 5/1971 | Vartanian | 89/130 |
| 3,657,960 | A | * | 4/1972 | Badali | 89/191.02 |
| 4,061,074 | A | | 12/1977 | Johnson et al. | |
| 4,389,920 | A | * | 6/1983 | Dufour, Sr. | 89/190 |
| 4,942,802 | A | | 7/1990 | Stoner | |
| 5,117,735 | A | | 6/1992 | Flashkes | |
| 5,351,598 | A | * | 10/1994 | Schuetz | 89/185 |
| 5,900,577 | A | * | 5/1999 | Robinson et al. | 89/191.01 |

FOREIGN PATENT DOCUMENTS

| | | | | |
|---|---|---|---|---|
| EP | 789217 A1 | * | 8/1997 | F41A/5/18 |
| EP | 1215464 A1 | * | 6/2002 | F41A/5/18 |

* cited by examiner

*Primary Examiner*—Charles T. Jordan
*Assistant Examiner*—John W. Zerr
(74) *Attorney, Agent, or Firm*—Raymond M. Galasso; Simon, Galasso & Frantz PLC

(57) ABSTRACT

An apparatus adapted for actuating a bolt carrier group apparatus comprising a piston tube attached to a receiver assembly. An operating rod is disposed in a bore of the piston tube. A piston is engaged with a first end of the operating rod. The operating rod moves from a static position to a displaced position when a combustion gas is exposed to a face of the piston. A bolt carrier including a bolt carrier lug is disposed in a bolt carrier lug channel of an upper receiver body. A tappet rod is engaged with the bolt carrier lug. The tappet rod moves substantially in unison with the operating rod. A yoke is attached to the tappet rod and to the operating rod. The yoke is mounted movably on the piston tube. An adjustable pressure regulator is coupled to the piston tube for regulating discharge of the combustion gas therethrough.

12 Claims, 22 Drawing Sheets

APPARATUS AND METHOD FOR ACTUATING A BOLT CARRIER GROUP OF A RECEIVER ASSEMBLY

CROSS-REFERENCE TO RELATED APPLICATION

This is a Divisional Utility patent application to co-pending U.S. Utility patent application having Ser. No. 09/734,279 filed on Dec. 11, 2000.

BACKGROUND OF THE INVENTION

The disclosures herein relate generally to firearms, and more particularly to firearm upper receivers with belt-feed capability.

Many firearms, such as assault rifles, that are commonly used in military situations are not designed by their manufacturer for use with belt-feed ammunition. Typically, such firearms are designed by their manufacturer for receiving ammunition from an ammunition magazine. The AR-15 family of firearms, including the M-16 type firearms, illustrate examples of assault rifles that are designed by their manufacturer to receive ammunition exclusively from an ammunition magazine. M-16 type firearms are a military version of the AR-15 family of firearms capable of operating in a fully automatic mode. M-16 type firearms have been manufactured by companies including, but not limited to Colt Manufacturing Company, the ArmaLite Division of Fairchild Aircraft and Engine Company, BushMaster Firearms Incorporated and Fabrique Nationale. A standard ammunition magazine for M-16 type firearms holds approximately 30 rounds of ammunition. The versatility of firearms that are intended for use in military situations and that are designed for receiving ammunition exclusively from an ammunition magazine is significantly limited.

Some firearms, such as M-16 type firearms, may be operated in a fully automatic mode. When being operated in the fully automatic mode, firing of a round of ammunition automatically facilitates ejection of each spent round from the firing chamber and chambering of a new round into the firing chamber. As long as the trigger of such as firearm is depressed, the firearm will continue to fire until all of the ammunition is depleted.

Due to the attainable firing rate of firearms operated in a fully automatic mode and the limited ammunition capacity of standard ammunition magazines, the use of ammunition magazines with such firearms results in a significant amount of down-time of the firearm for allowing a depleted magazine to be replaced with a full ammunition magazine. Most automatic firearms are capable of firing ammunition at a rate of 150 rounds or more per minute. At a firing rate of 150 rounds per minute, a 30 round ammunition magazine can be depleted of ammunition in as little as about 12 seconds of continuous firing.

In many situations, such as in military combat, a high-capacity ammunition delivery system such as a belt-feed system is preferred over an ammunition magazine. A typical ammunition belt for a belt-feed system holds 200 or more rounds of ammunition. At a firing rate of 150 rounds per minute, a 200 round ammunition belt can be depleted in as little as about 80 seconds. Accordingly, for a given firearm design, the minimum time to depletion of a 200 round ammunition belt is as much as about 7 times greater than that of a 30 round ammunition magazine. As a result of the increased time to depletion, belt-feed ammunition systems are preferred in many military situations.

Attempts have been made to increase the versatility of magazine-fed firearms by modifying them to accept belt-feed ammunition. The CAR-15 heavy assault rifle model M2, developed by Colt Manufacturing Company, illustrates an example of such a modified firearm. The ArmaLite Division of the Fairchild Engine and Airplane Corporation also developed such a modified firearm for receiving magazine-fed and belt-feed ammunition.

To date, magazine-fed firearms that have been modified to accept belt-feed ammunition, including those discussed above, have required modification to an upper receiver assembly and a lower receiver assembly of the firearm. Facilitating modifications to the upper and to the lower receiver assemblies is costly. Furthermore, the lower receiver assembly of many firearms, such as M-16 type firearms, is the registerable portion of the firearm that carries a serial number for enabling compliance with registration requirements of the United States Bureau of Alcohol, Tobacco & Firearms. As a result of the lower receiver assembly being the portion of the firearm that is registerable, it can only be modified legally by a licensed firearm manufacturer.

The bolt carrier group of many automatic firearms, such as M-16 type firearms, are energized using pressure generated by the combustion of powder in a cartridge. Such firearms are considered to be gas energized. In such firearms, it is typical for combustion gas to be routed from the barrel to the receiver assembly that carries the bolt carrier group (referred to herein as the bolt-carrying receiver). In this manner, pressure associated with the combustion gas is used to supply the energy needed for facilitating ejection of a spent cartridge from the firing chamber and feeding of a new round of ammunition into the firing chamber. Accordingly, the bolt carrier groups of types of firearms are gas driven as well as gas energized.

The routing of the combustion gas to the bolt-carrying receiver results in several adverse situations. One adverse situation is that over time, deposits from the combustion gas are formed inside the bolt-carrying receiver. Such deposits adversely affect operation of the firearm and, in some cases, prevent its operation until the bolt-carrying receiver is cleaned. Another adverse situation is that the combustion gases are vented into the general area of an operator's face, impairing the operator's sight and respiration.

Accordingly, what is needed is a receiver assembly capable of reducing the shortcomings associated with conventional gas-driven automatic firearms that are manufacturer configured for receiving ammunition exclusively from an ammunition magazine.

SUMMARY OF THE INVENTION

One embodiment of a firearm receiver system includes an upper receiver assembly capable of receiving magazine-fed ammunition and belt-fed ammunition. A lower receiver is attached to the upper receiver assembly. The lower receiver assembly is capable of having an ammunition magazine attached thereto for communicating ammunition from the ammunition magazine to the upper receiver assembly. An ammunition belt feeding assembly is attached to the upper receiver assembly for communicating ammunition from an ammunition belt to the upper receiver assembly.

DETAILED DESCRIPTION

Figure 1A:
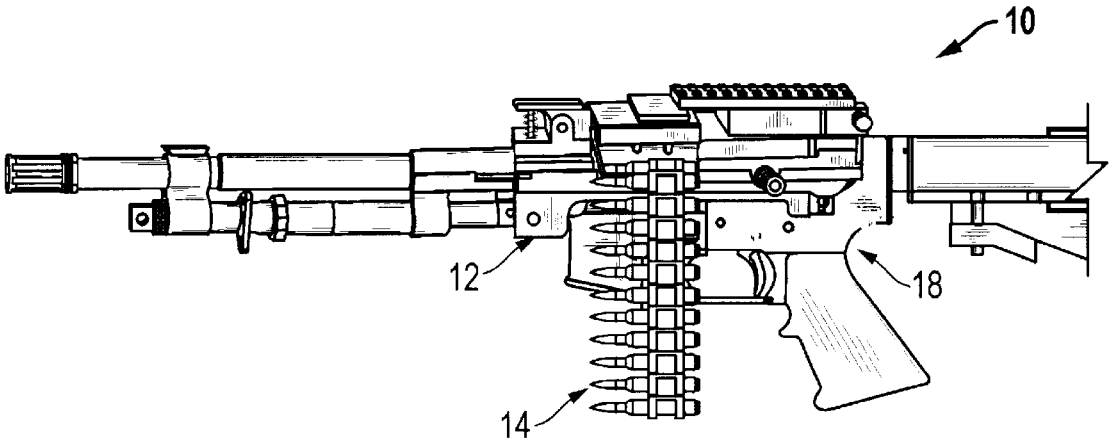
FIG. 1A is a side view illustrating an embodiment of a firearm having an ammunition belt attached to an upper receiver assembly.
Figure 1B:
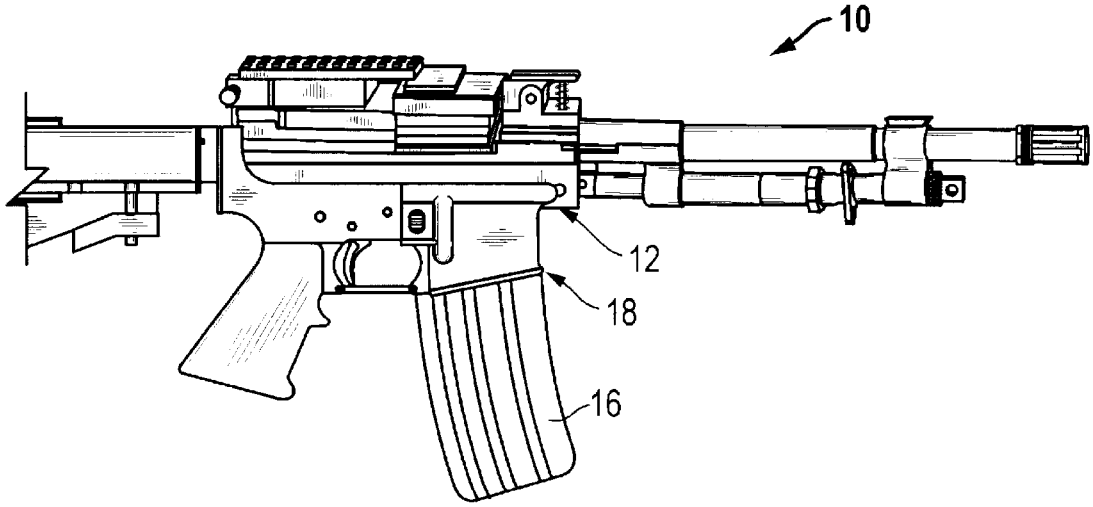
FIG. 1B is a side view of the firearm of FIG. 1A having an ammunition magazine attached to a lower receiver assembly, and the ammunition belt detached from the upper receiver assembly.
Figure 1C:
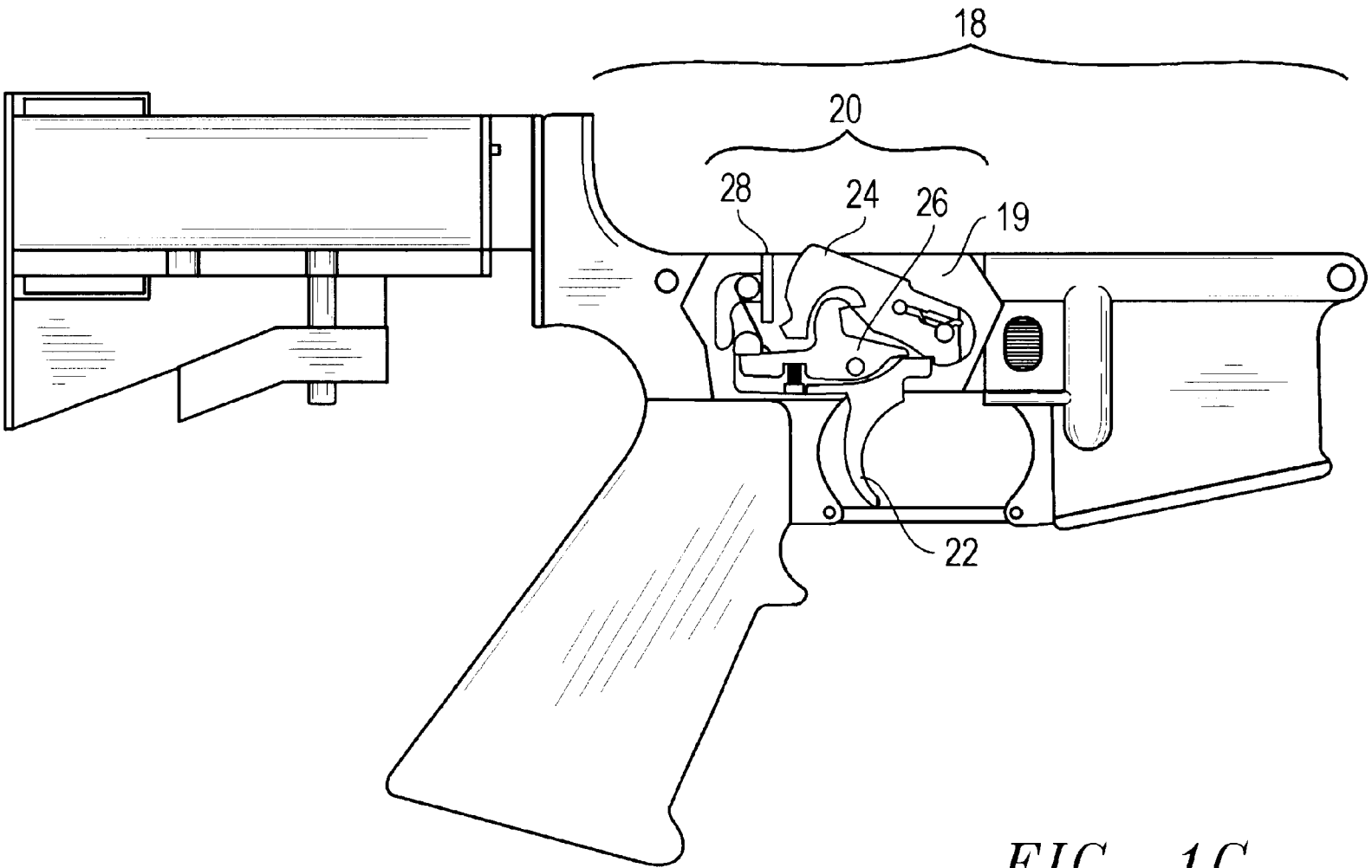
FIG. 1C is a side view illustrating an embodiment of a trigger group in the lower receiver assembly of the firearm of FIG. 1A.

An embodiment of a firearm 10 including an upper receiver assembly 12 and having an ammunition belt 14 attached to the upper receiver assembly 12 is depicted in FIG. 1A. The firearm 10 is depicted in FIG. 1B having an ammunition magazine 16 attached to a lower receiver assembly 18 of the firearm 10. As depicted in FIG. 1C, the lower receiver assembly 18 includes a lower receiver body 19 having a trigger group 20 mounted thereon. The trigger group 20 comprises a trigger 22, a hammer 24, a disconnect 26, and an automatic sear 28.

A lower receiver assembly from an M-16 type firearm illustrates an example of the lower receiver assembly 18. M-16 type firearms are manufacturer configured for receiving ammunition exclusively from an ammunition magazine attached to their lower receiver assembly. The upper and lower receiver assemblies of an unmodified M-16 type firearm illustrate examples of as-manufactured original equipment manufacturer (OEM) upper and lower receiver assemblies.

It is advantageous to enable a firearm configured by its manufacturer for receiving ammunition exclusively from an ammunition magazine to also receive ammunition from an ammunition belt. For firearms having a registerable lower receiver assembly, it is particularly advantageous for the an upper receiver assembly capable of supplying ammunition from an ammunition belt to be mountable on an unmodified lower receiver assembly. In this manner, such an upper receiver assembly may be legally fitted to the registerable lower receiver assembly by parties other than the manufacturer.

Figure 2A:
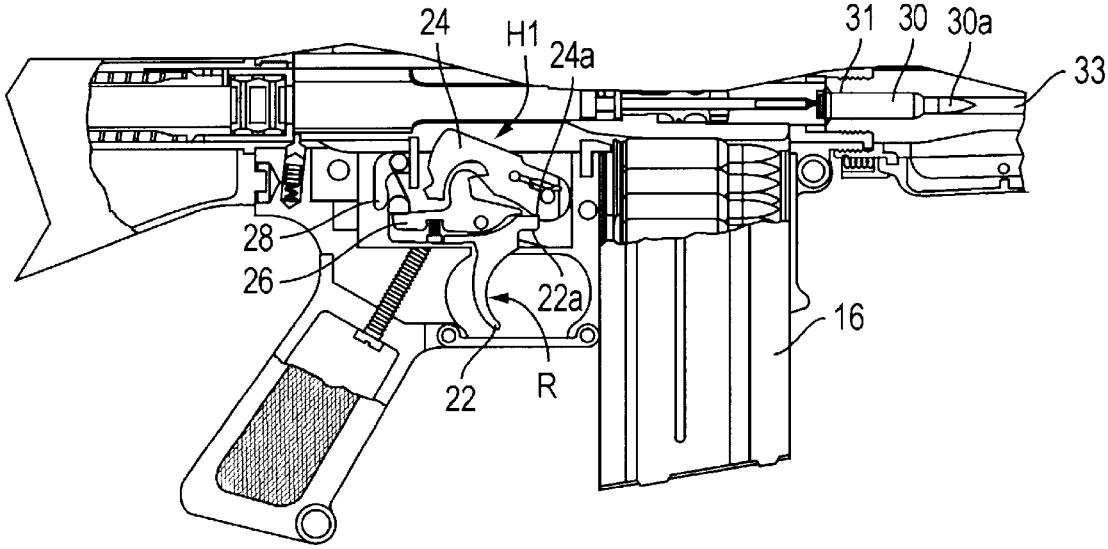
FIGS. 2A–2H are fragmentary side views illustrating an embodiment of an operational cycle of the firearm of FIG. 1B with the ammunition being supplied from an ammunition magazine.

An embodiment of an operational cycle of the firearm 10 for ammunition supplied from the magazine 16 is depicted in FIGS. 2A–2H. When the firearm 10 has a selector switch (not depicted) set for semi-automatic fire, the operational cycle begins with a chambered round 30 in a firing chamber 31 and the hammer 24 in a cocked position H1 with a lower hammer notch 24*a* engaged with a trigger sear 22*a*, as depicted in FIG. 2A. Each round of ammunition includes a cartridge and a bullet. The chambered round 30 includes a bullet 30*a* that is projected down a barrel 33 when the chambered round 30 is fired.

Figure 2B:
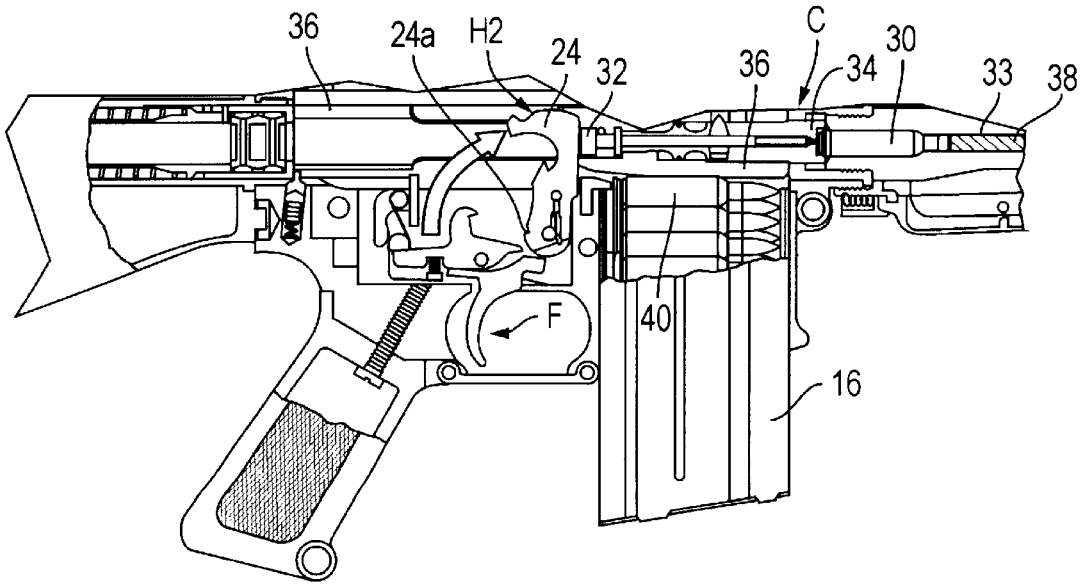

As the trigger 22 is pulled from a ready position R, FIG. 2A, to a firing position F, FIG. 2B, the hammer 24 is released and rotates forward, striking a firing pin 32 thereby causing the chambered round 30 to be fired and a bullet 30*a,* FIG. 2A, to be projected down a barrel 33. The firing pin 32 is mounted on a bolt 34 and the bolt 34 is mounted on a bolt carrier 36. A bolt carrier group comprises the bolt 34 and the bolt carrier 36. As the bullet 30*a* travels down the barrel 33, combustion gas 38 creates pressure in the barrel 33 between the bullet 30*a* and the chambered round 30, FIG. 2B. The pressure associated with the combustion gas 38 facilitates ejection of the chambered round 30 and chambering of an unfired round 40 via a conventional gas-driven bolt actuating technique, such as that used in Colt M-16 type firearms, or an embodiment of a piston-driven bolt actuating technique as disclosed herein.

Figure 2C:
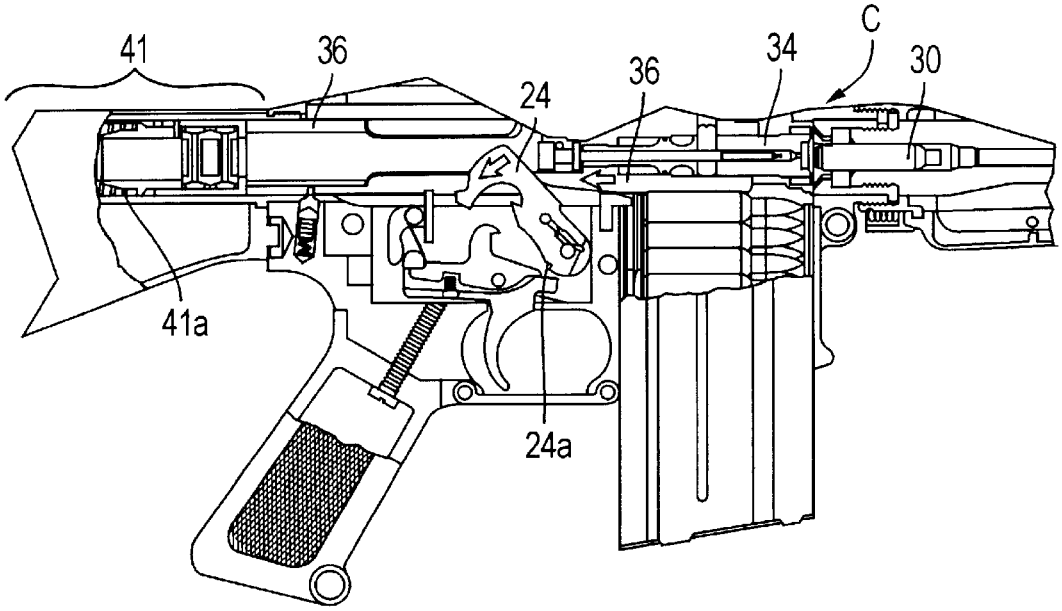
Figure 2D:
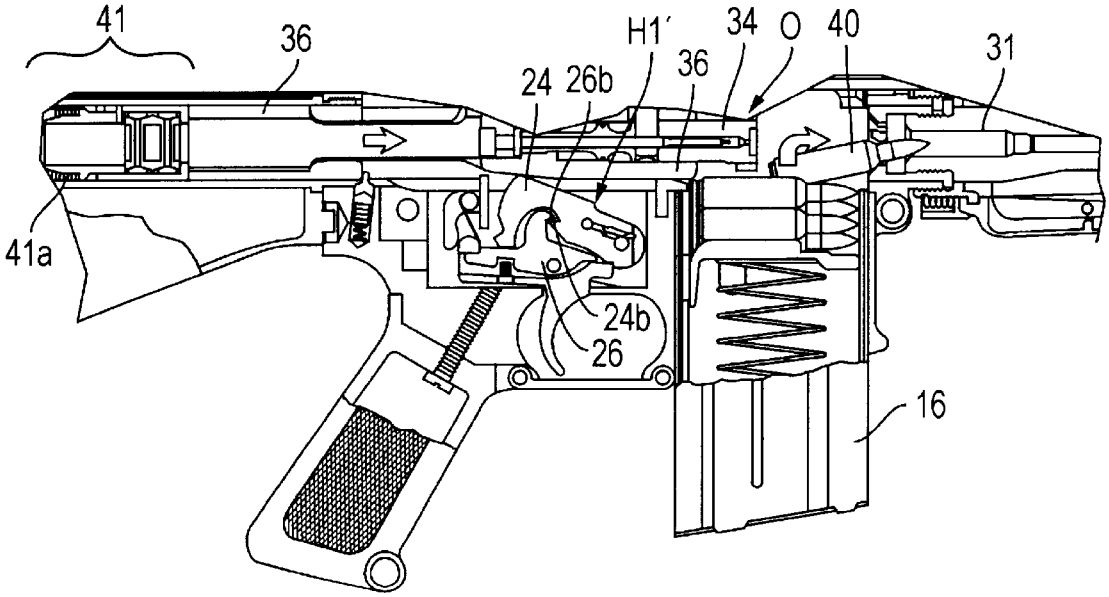
Figure 2E:
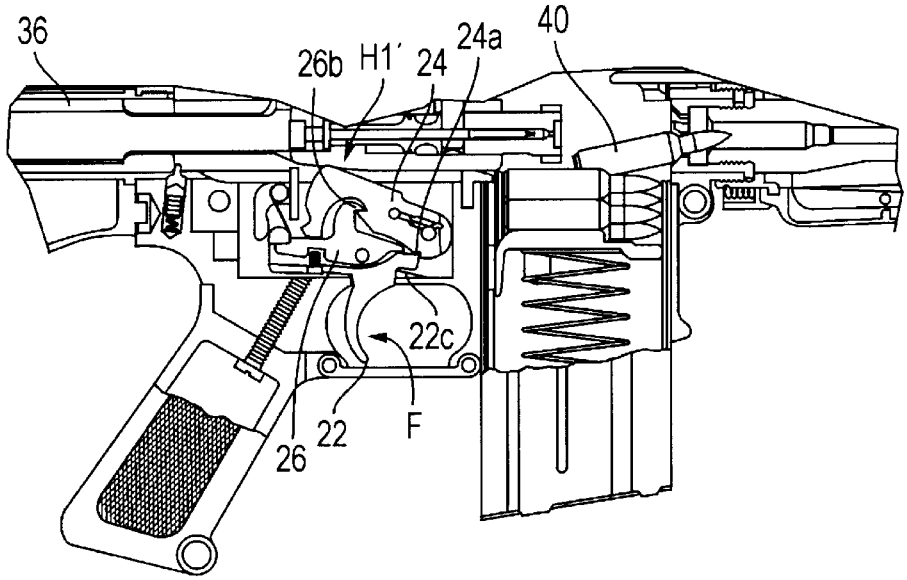
Figure 2F:
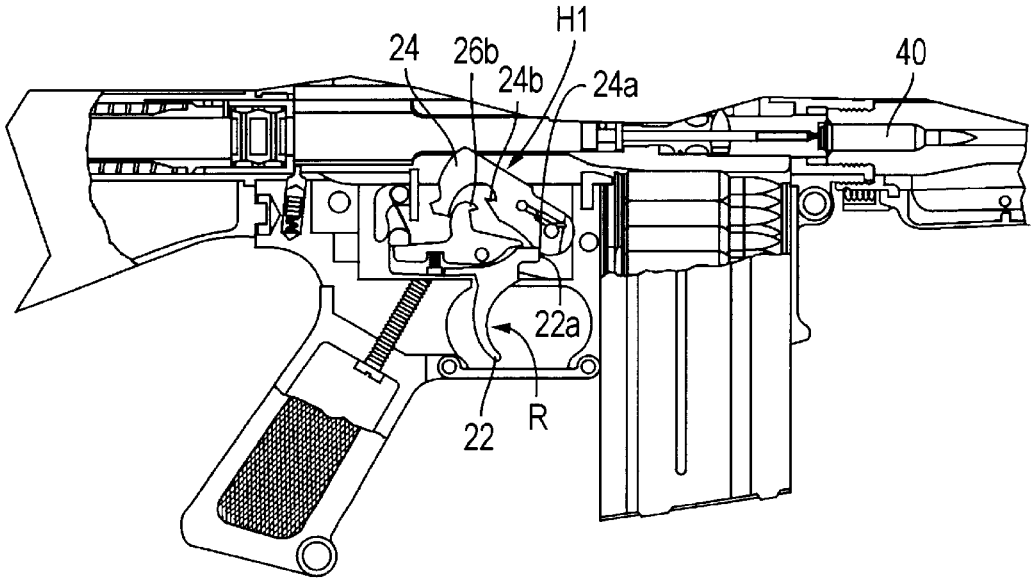
Figure 2G:
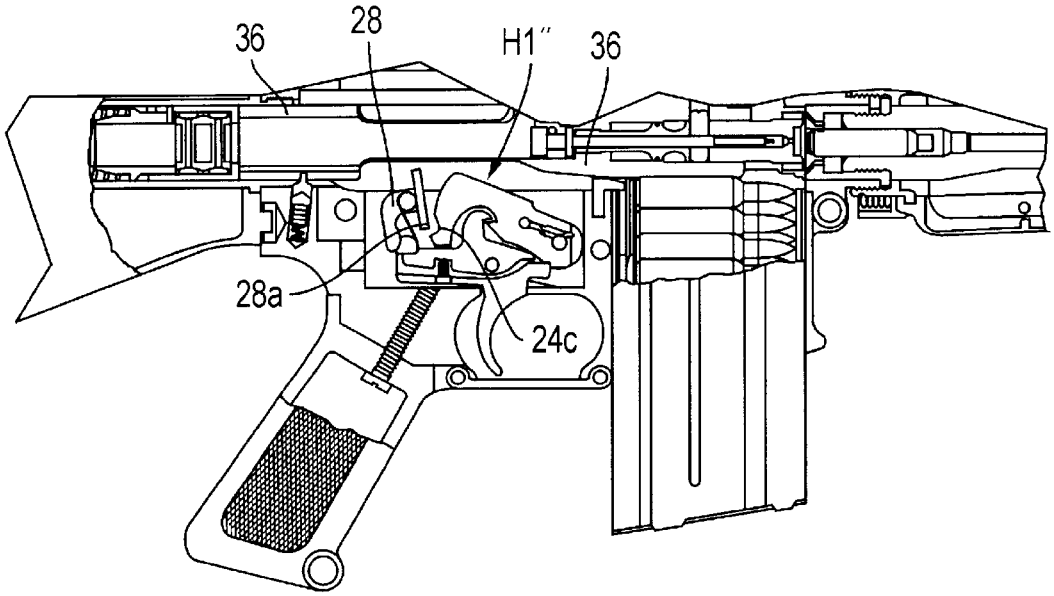
Figure 2H:
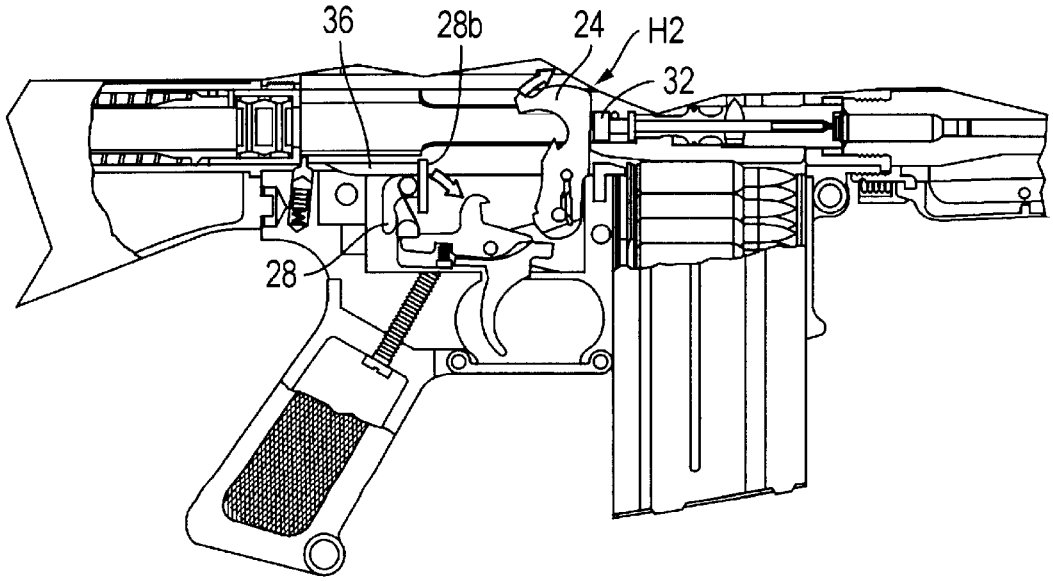

Regardless of the bolt actuating technique used, firing of the chambered round 30 results in the bolt 34 and the bolt carrier 36 being moved in a rearward direction away from the barrel 33 from a closed position C, FIG. 2C, toward an open position O, FIG. 2D. Accordingly, the bolt carrier group and all of its components are moved from the closed position C toward the open position O. In response to the bolt carrier 36 being moved in the rearward direction, the bolt 34 is rotated such that lugs of the bolt 34 are unlocked from corresponding lugs of a barrel extension. In this manner, the bolt 34 is free to move, as a component of the bolt carrier group, from the closed position C toward the open position O. As the bolt 34 and bolt carrier 36 move in the rearward direction, the chambered round 30 is withdrawn from the firing chamber 31 and is ejected from the firearm 10 through an ejection port. The movement of the bolt carrier 36 in the rearward direction also returns the hammer 24 from a firing H2, FIG. 2B, to the cocked position H1', FIG. 2D, with an upper hammer notch 24*b* engaged with a disconnect hook 26*b*.

The rearward movement of the bolt carrier 36, and consequently the bolt 34, is arrested by a buffer assembly 41, FIG. 2C. The buffer assembly 41 includes an action spring 41*a* that is compressed by the bolt carrier 36 during its rearward movement. As depicted in FIG. 2D, the compressed action spring 41*a* forces the bolt carrier group in a forward direction towards the closed position C, towards the barrel 33. Upon moving forward toward the closed position C, the bolt 34 engages the unfired round 40 in the magazine 16 and thrusts the unfired round 40 into the firing chamber 31, FIG. 2E. As the bolt carrier 36 and the bolt 34 continue to move towards the closed position C, the lugs of the bolt 34 enter the bolt extension of the barrel 33 and the bolt 34 engages a face of the barrel extension. An ejector pin is depressed against the unfired round 40 and an extractor snaps into an extracting groove of the unfired round 40, facilitating ejection after the unfired round 40 is fired.

While the bolt 34 is engaged with the face of the barrel extension, the bolt carrier 36 continues to move towards the closed position C. As the bolt carrier 36 continues to move in the forward direction toward the closed position C, the bolt 34 is rotated such that the lugs of the bolt 34 are locked relative to the lugs of the barrel extension. The bolt carrier group is said to be in the closed position C when the lugs of the bolt 34 are locked relative to the lugs of the barrel extension. Mechanisms and techniques for rotating the bolt 34 such that the lugs can be locked and unlocked from the lugs of the barrel extension are disclosed below in greater detail.

When the selector switch is set to the semi-automatic position, firing the unfired round 40 requires releasing and pulling the trigger 22 for each fired round. When the trigger is released, a trigger spring 22*c*, FIG. 2E, causes the trigger 22 to move from the firing position F to the ready position R, FIG. 2F. Releasing the trigger 22 also causes the upper hammer notch 24*b* to disengage from the disconnect hook 26*b*. In this manner, the hammer 24 is released, allowing it to move to the cocked position H1, FIG. 2F, with the lower hammer notch 24*a* engaged with the trigger sear 22*a*. The firearm is now ready to fire the unfired round 40.

Moving the selector switch (not depicted) to the automatic position permits the firearm to operate in a fully automatic mode. With the selector switch set in the automatic position, FIG. 2G, a lower edge 28*a* of the automatic sear 28 engages a top outside hammer notch 24*c* during the rearward movement of the bolt carrier 36. This action holds the hammer 24 in the automatic cocked position H1". During the forward movement of the bolt carrier 36, FIG. 2H, the bolt carrier 36 strikes an upper edge 28*b* of the automatic sear 28, releasing the automatic sear 28 from the hammer 24 thereby permitting the hammer 24 to strike the firing pin 32 and fire the unfired round 40. In this manner, rounds of ammunition will be automatically fired, ejected and chambered until the trigger 22 is released or all of the rounds are used.

Figure 3A:
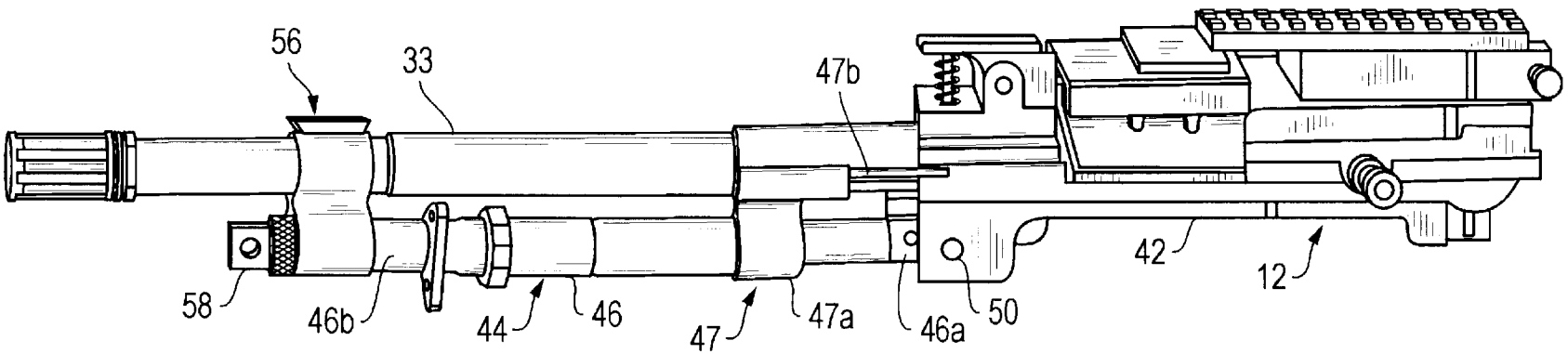
FIG. 3A is a side view illustrating an embodiment of an upper receiver assembly having a piston tube assembly and a barrel assembly attached thereto.
Figure 3B:
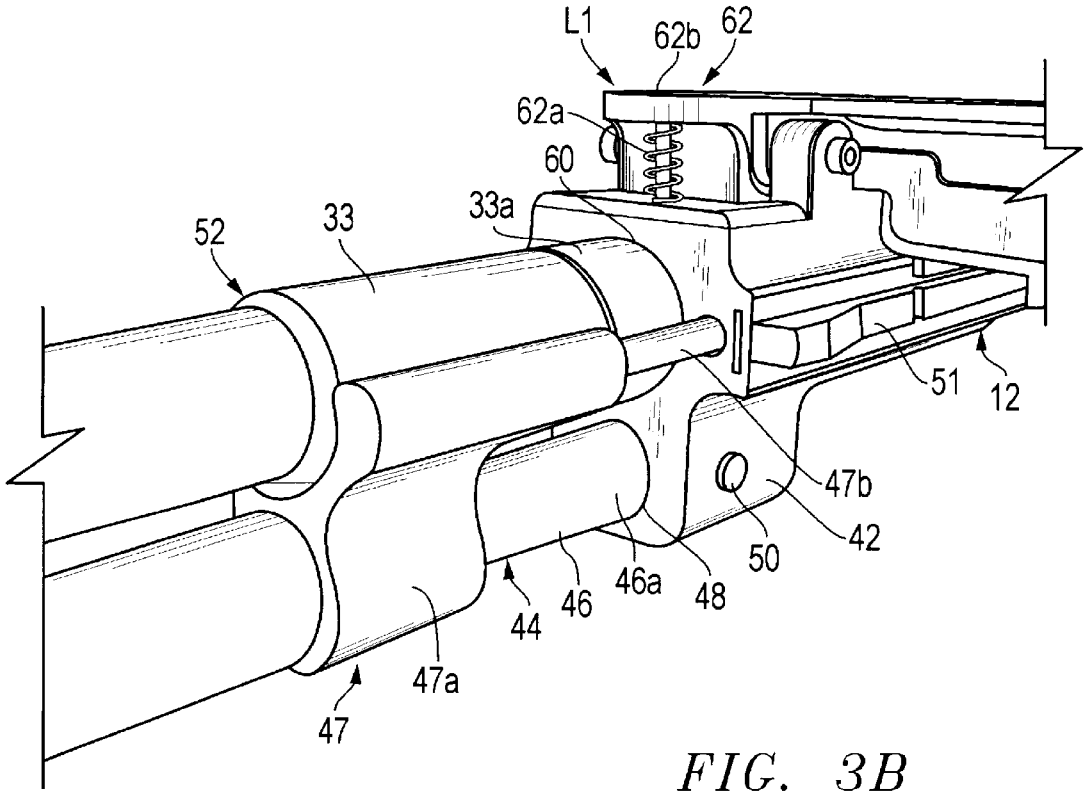
FIG. 3B is a perspective view of the upper receiver assembly, the piston tube assembly and barrel assembly depicted in FIG. 3A.

As depicted in FIGS. 3A and 3B, the upper receiver assembly 12 includes an upper receiver body 42. A piston tube assembly 44 is attached to the upper receiver body 42. The piston tube assembly 44 includes a piston tube 46 having a tappet assembly 47, FIG. 3B, movably mounted thereon. The piston tube 46 includes a first end 46*a* that is mounted in a piston tube receptacle 48 of the upper receiver body 42. A press pin 50 extends through the upper receiver body 42 and a corresponding hole in the piston tube 46, securing the piston tube 46 in place relative to the upper receiver body 42.

The tappet assembly 47, FIG. 3B, includes a yoke 47*a* that rides on the piston tube 46 and a tappet rod 47*b* attached to the yoke 47*a*. The tappet rod 47*b* extends from the yoke 47*a* through the upper receiver body 42 into contact with a bolt carrier lug 36*a,* FIG. 7 that is movably mounted on the upper receiver body 42. The tappet rod 47*b* and a charging member 51 extend along substantially parallel longitudinal axes.

Figure 4:
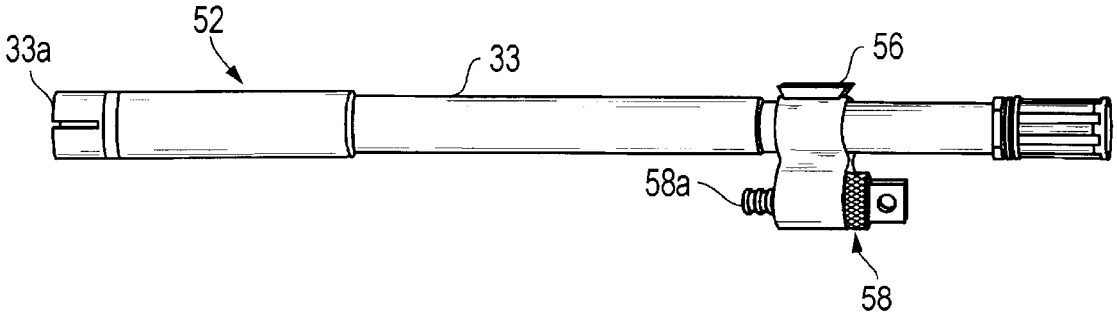
FIG. 4 is side view illustrating the barrel assembly depicted in FIG. 3A.

A barrel assembly 52, FIGS. 3–4, is configured for being attached to the upper receiver assembly 12. The barrel assembly 52 includes the barrel 33 (discussed above in reference to FIGS. 2A–2H) and a gas block 56, FIGS. 3A and 4, attached to the barrel 33. A pressure regulator 58, FIGS. 3A and 4, is mounted in the gas block 56. A first end 33*a* of the barrel 33 is configured for being received in a barrel receptacle 60, FIG. 3B, of the upper receiver body 42. A nipple 58*a,* FIG. 4, of the pressure regulator 58 is configured for being received in a second end 46*b*, FIG. 3A, of the piston tube 46.

As depicted in FIG. 3B, the upper receiver assembly 12 includes a barrel retention mechanism 62 pivotally mounted thereon for securing the barrel assembly 52 to the upper receiver body 42. The barrel retention mechanism 62 is biased by a spring 62*a* to a locked position L1. By depressing a release lever portion 62*b* of the barrel retention mechanism 62, a pin extending through the upper receiver body 42 is disengaged from the barrel 33, permitting the barrel 33 to be withdrawn from the barrel receptacle 60.

Figure 5A:
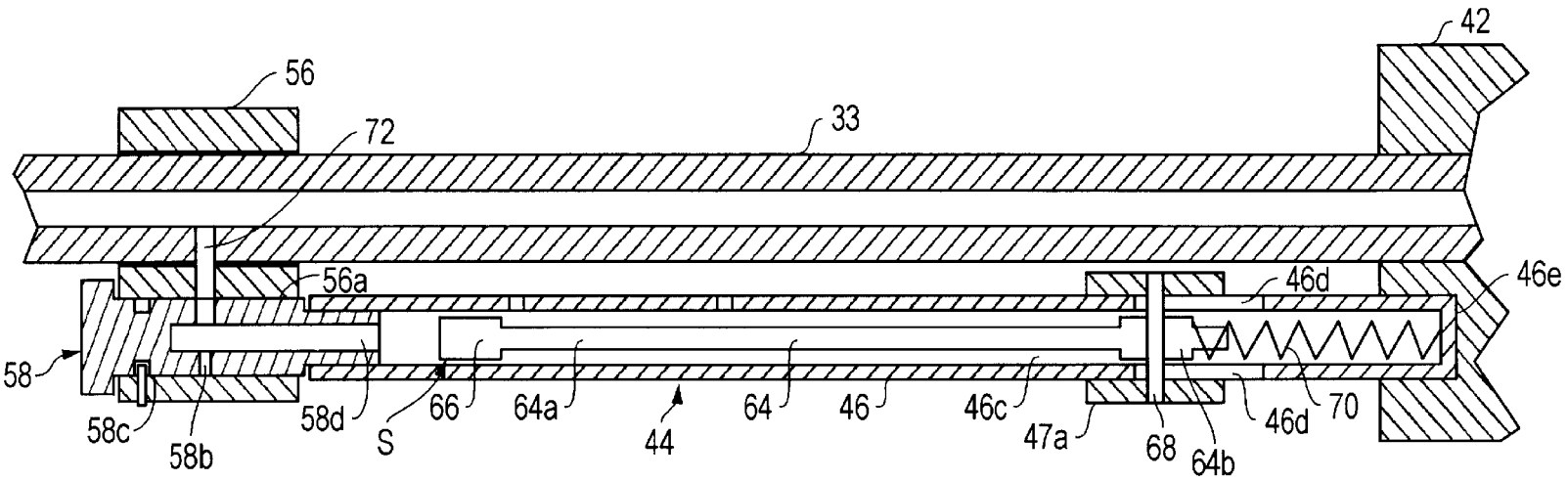
FIGS. 5A and 5B are cross-sectional views illustrating an embodiment of a firearm having an adjustable gas regulator coupled to a piston tube assembly for displacing a tappet assembly, with an operating rod of the piston tube assembly being in a static position and a displaced position, respectively.
Figure 5B:
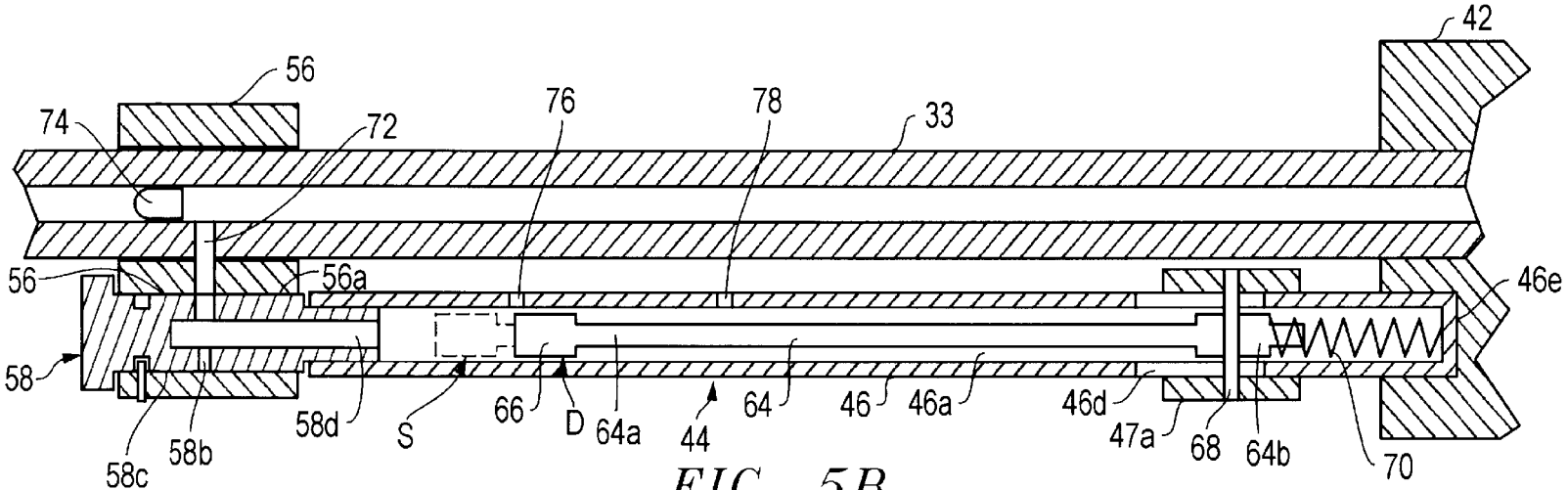

Referring to FIGS. 5A and 5B, the piston tube assembly 44 includes an operating rod 64 movably mounted in a bore 46*c* of the piston tube 46. A piston 66 is attached at a first end 64*a* of the operating rod 64. The yoke 47*a* is attached to the operating rod 64 by a pin 68. The pin 68 extends through the yoke 47*a* and the operating rod 64. The piston tube 46 has opposing elongated slots 46*d* through which the pin 68 extends, allowing the yoke 47*a* and the operating rod 64 to move along the longitudinal axis of the piston tube 46. A return spring 70 is captured in the bore 46*c* of the piston tube 46 between a second end 64*b* of the operating rod 64 and a closed end portion 46*e* of the piston tube 46. The return spring 70 biases the operating rod 64 to a static position S.

A passage 72 extends through the barrel 33 to a pressure regulator receptacle 56*a* of the gas block 56. The pressure regulator 58 depicted in FIGS. 5A and 5B is an adjustable pressure regulator including a plurality of orifices 58*b* extending between an outer surface 58*c* and a gas communication passage 58*d* of the pressure regulator 58. During operating of the firearm 10, one of the orifices 58*b* is aligned with the passage 72.

When a chambered round of ammunition in the firearm 10 is fired, FIG. 5B, a bullet 74 travels down the bore of the barrel 33. Firing of the chambered round of ammunition produces combustion gases creating pressure in the bore of the barrel 33 between the bullet 74 and the cartridge of the fired round of ammunition. When the bullet travels past the passage 72, a portion of the combustion gas travels through the passage 72 and the pressure regulator 58 into the bore 46*a* of the piston tube 46. In doing so, a face of the piston 66 is exposed to pressure associated with the combustion gases. The pressure drives the piston 66, and consequently the operating rod 64 from the static position S to a displaced position D, compressing the return spring 70.

One or more gas exhaust ports 76 are formed in the piston tube 46 adjacent to the displaced position D for venting the combustion gas to the ambient environment. Upon venting the combustion gases, the return spring 70 biases the piston 66 and operating rod 64 towards the static position S. A vent hole 78 may be provided in the piston tube 46 for relieving movement-induced pressure behind the piston 66.

The pressure regulator 58 may be rotated for individually aligning a particular one of the orifices 58*b* with the passage 72. By each of the orifices 58*b* being a different size, the amount of pressure exerted on the piston 66 can be selectively varied. In many situations, it will be advantageous to adjust the pressure that is exerted on the piston. For example, to maintain a desired level of performance of the firearm 10 as components of the firearm 10 wear, as the components become fouled from the combustion gas or when the firearm is used in different ambient environments, it is advantageous to be able to compensate for such situations. However, in some applications, the pressure regulator 58 may have only one orifice 58*b*, resulting in the pressure regulator being non-adjustable. In the case of a non-adjustable pressure regulator, the size of the orifice 58*b* will be determined based on a compromise for intended and predicted conditions.

Figure 6A:
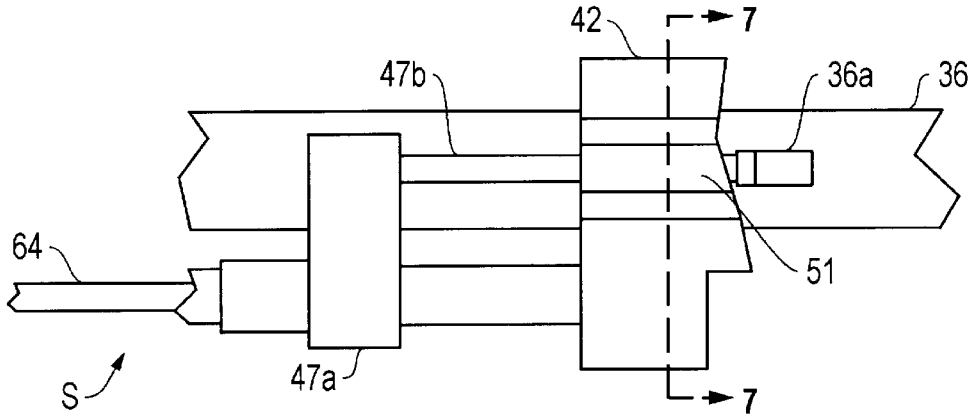
FIGS. 6A and 6B are side views illustrating an embodiment of a tappet assembly in relation to the displaced position and the static position, respectively, of the operating rod depicted in FIGS. 5A and 5B.
Figure 6B:
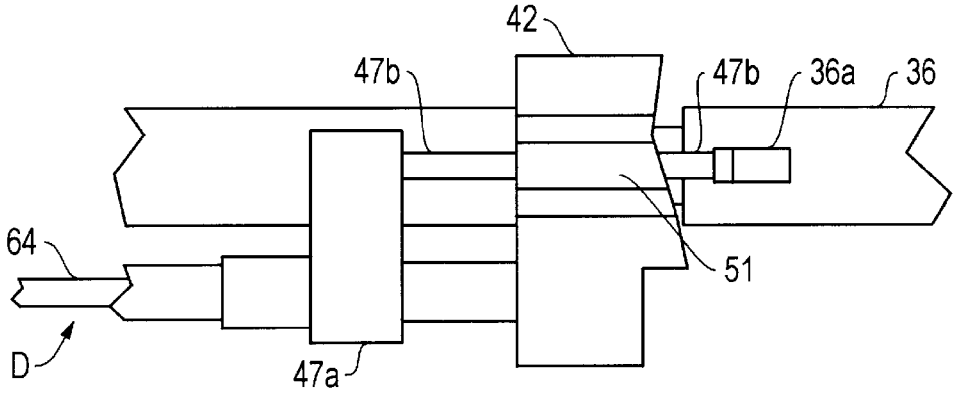

As depicted in FIGS. 6A and 6B, displacement of the operating rod 64 from the static position S to the displaced position D results in a corresponding displacement of the yoke 47*a*. The tappet rod 47*b* is engaged with the bolt carrier lug 36*a* of the bolt carrier 36. The bolt carrier lug 36*a* is constrained to forward and rearward movement in a bolt carrier lug channel 42*b*, FIG. 7, of the upper receiver body 42. Accordingly, the displacement of the operating rod 64 also results in a corresponding displacement of the bolt carrier 36. The displacement of the bolt carrier 36 that is associated with the displacement of the operating rod 64 is an initial displacement of the bolt carrier 36. Due to inertia associated with the speed at which the operating rod 64 is displaced, the bolt carrier 36 continues to travel after the operating rod 64 reached its maximum displacement. Thus, the overall displacement of the bolt carrier 36 is greater than the displacement of the operating rod 64. Accordingly, the upper receiver assembly is said to be gas energized and piston driven.

Implementation of embodiments of the piston tube assembly 44 and tappet assembly 47 are advantageous. One advantage is that the piston tube assembly 44 and the tappet assembly 47 transfer the energy associated with the combustion gases more efficiently to the bolt carrier 36. Because the piston 66 is mechanically coupled through the operating rod 64 and the tappet assembly to the bolt carrier 36, the length over which the combustion gases must travel to build sufficient pressure to energize the bolt carrier 36 is significantly reduced. Accordingly, the length over which compression of the combustion gas occurs is significantly reduced. By reducing the length over which compression of the combustion gases occurs and by mechanically coupling the piston 66 to the bolt carrier 36, the bolt 34 and the bolt carrier 36 are more efficiently moved from the closed position towards the open position.

Another advantage associated with the piston tube assembly 44 and the tappet assembly 47 relates to fouling of the firearm associated with the combustion gases. Conventional gas driven bolt actuation mechanisms result in fouling of the upper and lower receiver assemblies of a firearm. Fouling of the firearm can result in degraded performance of the firearm and, if not timely addressed, malfunction of the firearm. Because embodiments of the piston tube assembly 44 and the tappet assembly 47 disclosed herein preclude the need to route combustion gases to the upper receiver assembly 12, the potential for the combustion gases to foul of the upper receiver assembly 12 and the lower receiver assembly 18 is greatly reduced.

The piston tube assembly 44 and the pressure regulator 58 are susceptible to being fouled by the combustion gases. However, when these components require cleaning, they may be quickly and easily detached from the upper receiver assembly 12 to facilitate cleaning. It is a significant advantage that when fouled, the piston tube assembly 44 and the pressure regulator 58 can be detached, cleaned and re-attached to the upper receiver assembly 12 in a timely manner. Furthermore, because the piston tube assembly 44 is a unitary assembly, it can be quickly and easily replaced. In situations such as military combat, it may be desirable and advantageous to replace the piston tube assembly 44 rather than clean it.

Yet another advantage associated with embodiments of the piston tube assembly 44 disclosed herein is the location at which the combustion gases are vented. In some conventional firearms such as M-16 type firearms, during firing of the firearm, the combustion gases are vented from the firearm very close to the firearm operator's face. As a result, the vision and respiration of the operator may be impaired. Implementation of an embodiment of the piston tube assembly 44 disclosed herein results in the combustion gases being vented at a location that significantly reduces the potential for the vision and respiration of the operator to be impaired.

The design of this piston tube assembly 44 allows the tappet to contact a portion of the bolt carrier 36 that is not directly in line with the piston 66. In this manner, a bipod mounting bracket may be fitted to the piston tube 46 in a manner in which the bipod attachment does not hinder removal of the barrel 33. In conventional configurations, the bipod mounting bracket is attached to a barrel of a conventional weapon, thus making the barrel of such conventional weapon difficult to remove with the weapon supported on the bipod. Furthermore, this results in each such barrel having the added weight of a bipod mounting bracket.

Figure 7:
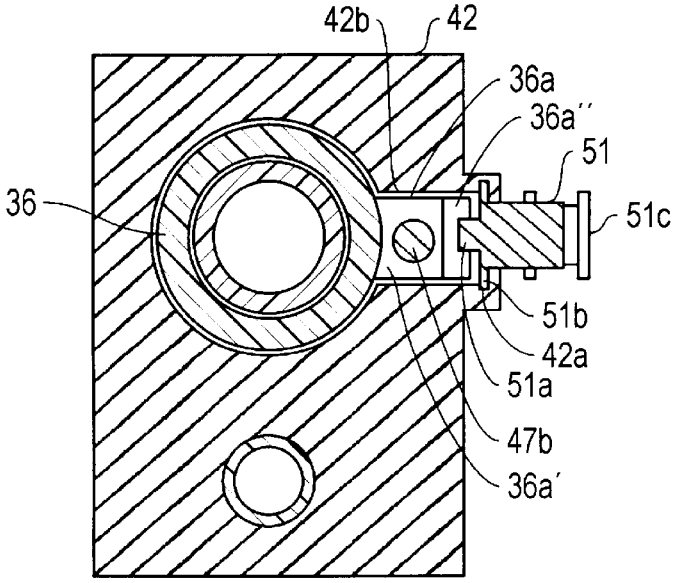
FIG. 7 is a cross-sectional view taken along the line 7—7 in FIG. 6A.

Referring to FIG. 7, the tappet rod 47*b* engages a first surface 36*a*' of the bolt carrier lug 36*a*. The charging member 51 includes a charging member lug 51*a* that engages a second surface 36*a*" of the bolt carrier lug 36*a*. The charging member 51 includes flanges 51*b* that are each received by a respective groove 42*a* of the upper receiver body 42, thus allowing the charging member 51 to be displaced relative to the upper receiver body 42. The configuration and orientation of the bolt carrier lug 36*a*, the tappet rod 47*b* and the charging member lug 51*a* permits the bolt carrier 36 to be manually displaced by pulling on a charging handle 51*c* of the charging member 51.

Figure 8:
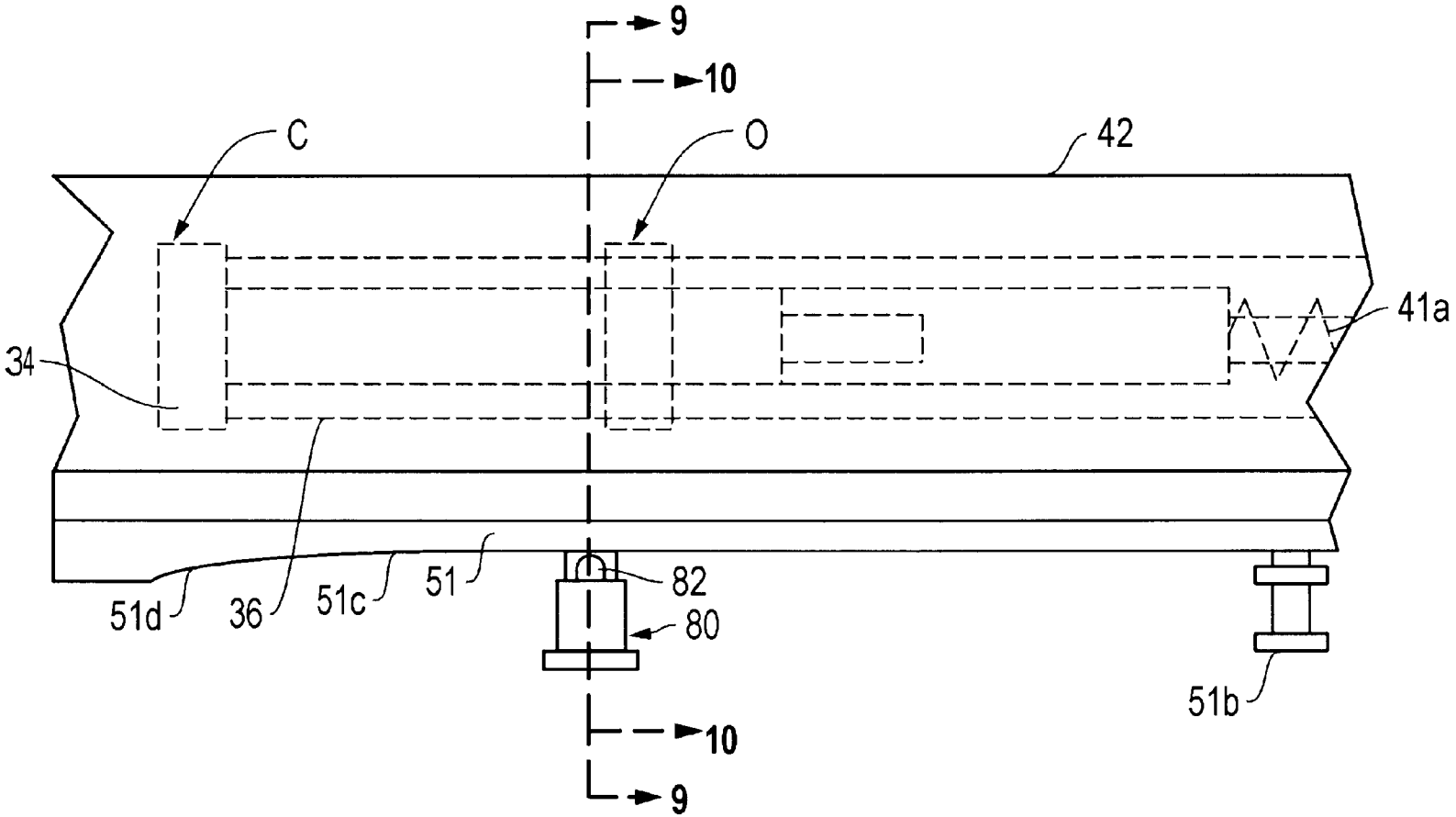
FIG. 8 is a partial top view illustrating an upper receiver assembly as disclosed herein.
Figure 9:
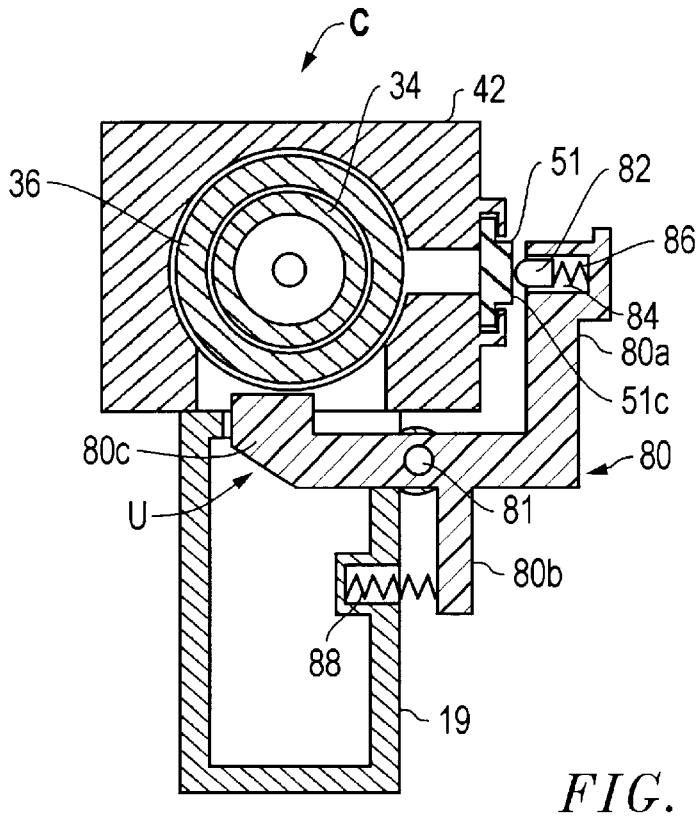
FIG. 9 is a cross-sectional view taken along the line 9—9 in FIG. 8, depicting a bolt catch in an unlocked position.
Figure 10:
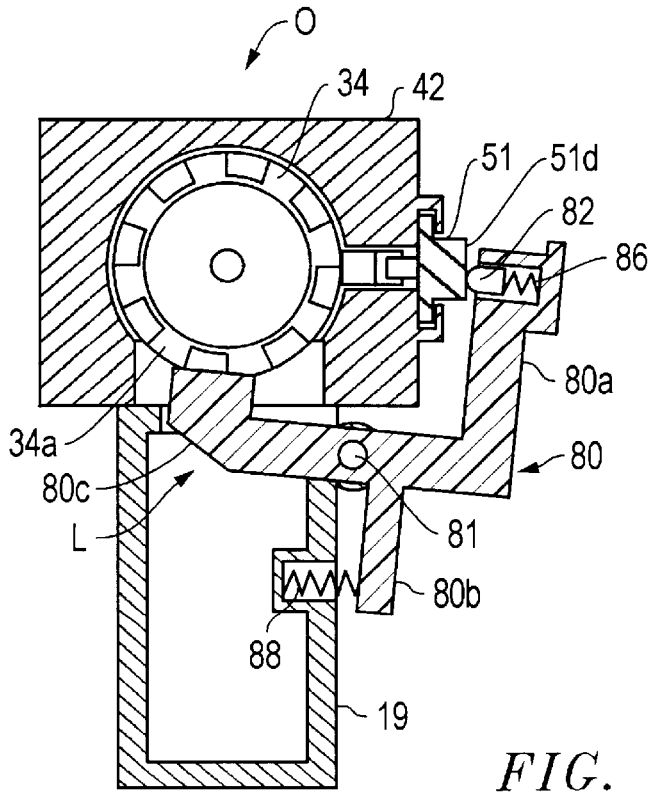
FIG. 10 is a cross-sectional view taken along the line 10—10 in FIG. 8, depicting a bolt catch in a locked position.

Referring to FIGS. 8–10, a bolt catch 80 is pivotally attached to the lower receiver body 19 at a pivot pin 81. The bolt catch 80 includes an upper leg 80*a* and a lower leg 80*b*. The pivot pin 81 is positioned between the upper leg 80*a* and the lower leg 80*b*. A contact pin 82 is mounted in a recess 84 of the upper leg 80*a* and engages a contact surface 51*c*, FIGS. 8 and 9, of the charging member 51. A first spring 86 is disposed in the recess 84, biasing the contact pin 82 away from the upper leg 80*a*. A second spring 88 is mounted between the lower leg 80*b* and the lower receiver body 19. The first and the second springs 86, 88 have respective spring rates such that the bolt catch 80 is biased to an unlocked position U, FIG. 9.

The bolt 34 and the bolt carrier 36 may be manually moved from the closed position C to the open position O, FIG. 8, by moving the charging member 51 in a rearward direction. When the charging member 51 is moved in the rearward direction, the contact pin 82 encounters a contoured portion 51*d* of the charging member 51. The position of the contoured portion 51*d* relative to the bolt 34 and the profile of the contoured portion 51*d* result in the bolt catch 80 being moved by the charging member 51 to a locked position L, FIG. 10, when the bolt 34 is moved to the open position O.

As mentioned above in reference to FIG. 2C, the bolt 34 and bolt carrier 36 are biased in a forward direction toward the closed position C by the action spring 41*a*. Accordingly, after the charging member 51 is moved in the rearward direction sufficiently, the bolt 34 is urged in the forward direction against a locking leg 80*c* by the action spring 41*a* as the charging member 51 is moved in the forward direction. In this manner, the locking leg 80*c* engages a face 34*a* of the bolt 34, thus holding the bolt 34 and the bolt carrier 36 in the open position O. By manually pressing the upper leg 80*a,* the bolt catch 80 is moved to the unlocked position U, disengaging the locking leg 80*c* from the face 34*a* of the bolt 34, thereby allowing the bolt 34 and bolt carrier 36 to return to the closed position C under the influence of the action spring 41*a*.

Implementation of an embodiment of the bolt catch 80 disclosed herein simplifies the operation of locking the bolt of a firearm in the open position. Many conventional bolt catches, such as that used on M-16 type firearms, require manual manipulation of the bolt catch to lock the bolt in the open position. In situations such as military combat, it is advantageous and desirable to preclude the need to manually manipulate the bolt catch when locking the bolt in the open position. Embodiments of the bolt catch 80 disclosed herein allow the bolt 34 to be locked in the open position O without requiring manual manipulation of the bolt catch 80. The bolt catch 80 described herein, can also be moved automatically from an unlocked position U to a locked position L, by action of a magazine follower from an empty magazine upon a protruding tang (not shown) on the bolt catch 80. This facilitates the rapid reloading of the weapon when used with ammunition magazines.

Figure 11:
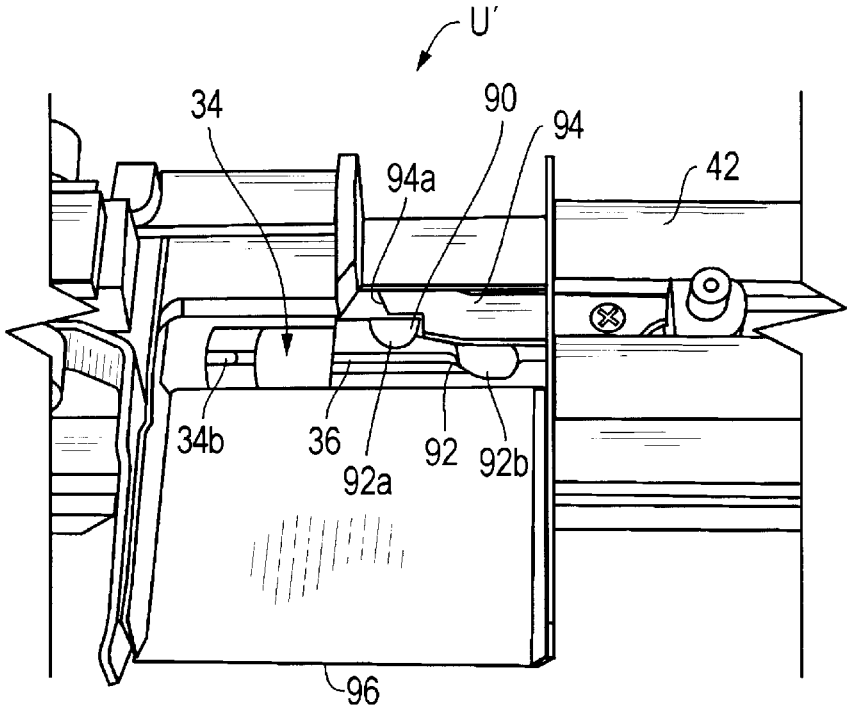
FIG. 11 is a partial perspective view illustrating an embodiment of a mechanism for rotating a bolt, with the bolt being depicted in an unlocked position.
Figure 12:
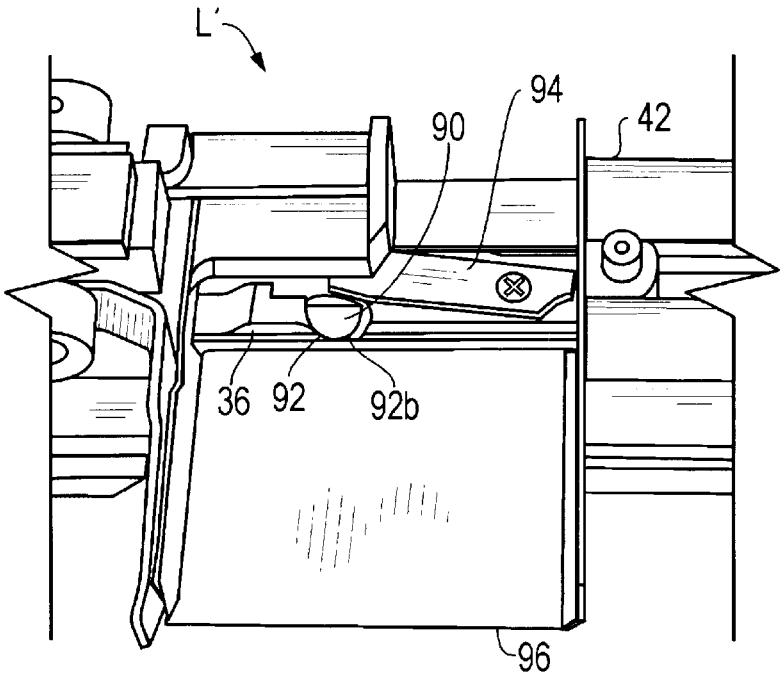
FIG. 12 is a partial top perspective view of the mechanism depicted in FIG. 11, with the bolt being depicted in a locked position.
Figure 13:
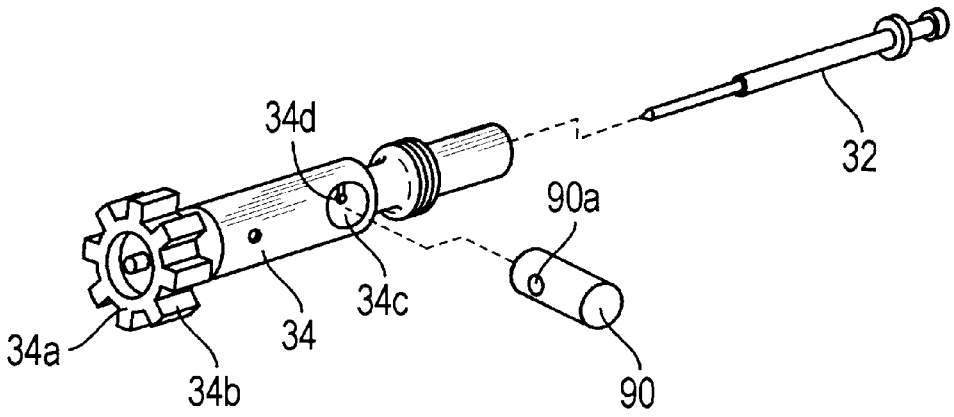
FIG. 13 is an exploded perspective view illustrating embodiments of a bolt, a firing pin, and cam pin.
Figure 14:
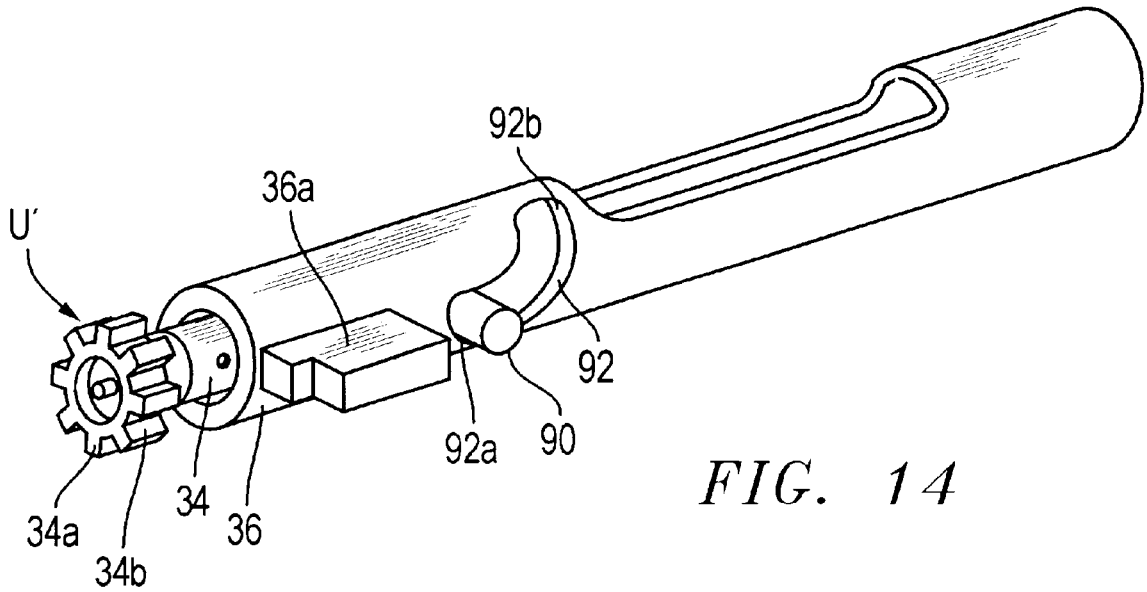
FIG. 14 is a perspective view illustrating another embodiment of a mechanism for rotating a bolt.
Figure 15:
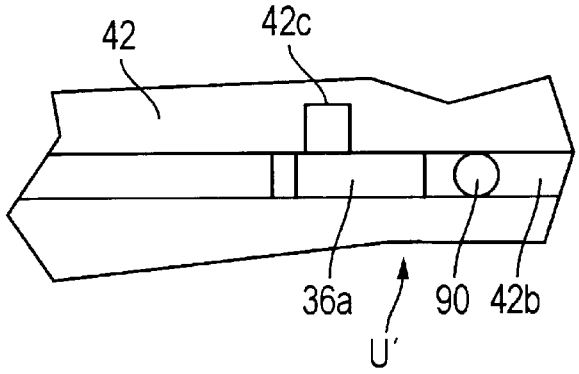
FIG. 15 is a partial side view of the mechanism depicted in FIG. 14 mounted in an upper receiver body, with the bolt being depicted in the unlocked position.
Figure 16:
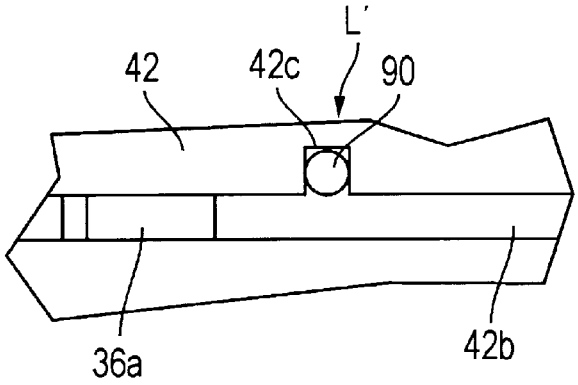
FIG. 16 is a partial side view of the mechanism depicted in FIG. 14 mounted in an upper receiver body, with the bolt being depicted in the locked position.
Figure 17:
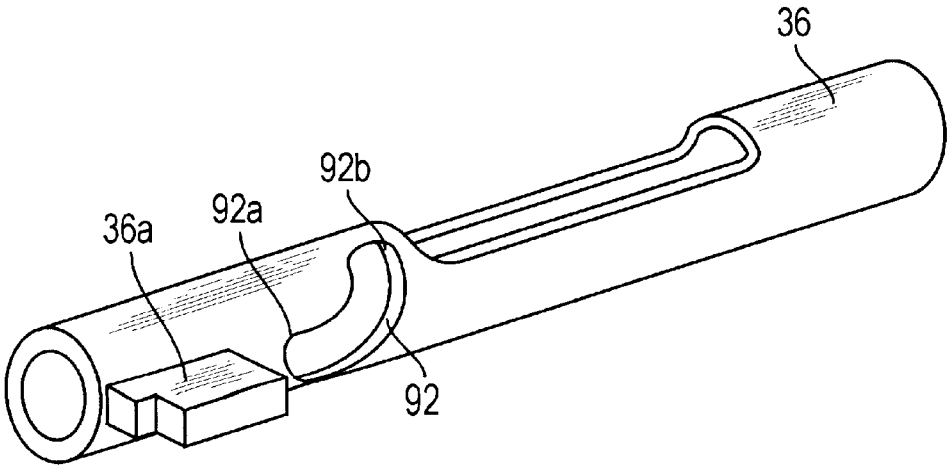
FIG. 17 is a perspective view illustrating an embodiment of a bolt carrier of the mechanism depicted in FIG. 14.
Figure 18:
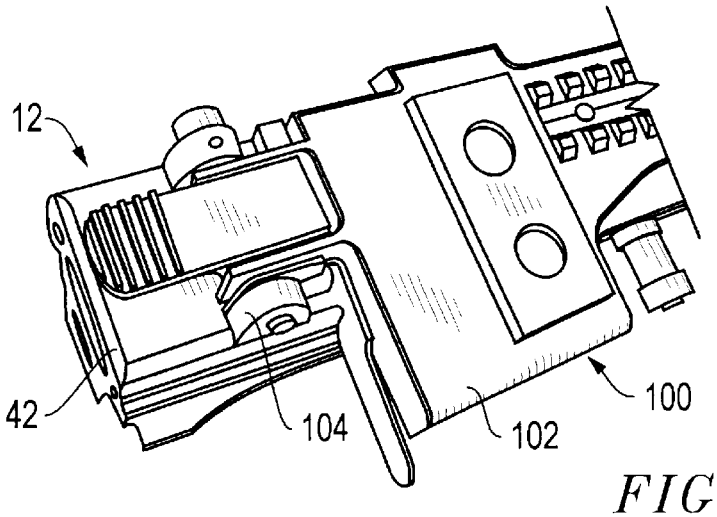
FIG. 18 is a partial perspective view illustrating an embodiment of an ammunition belt feeding assembly.
Figure 19:
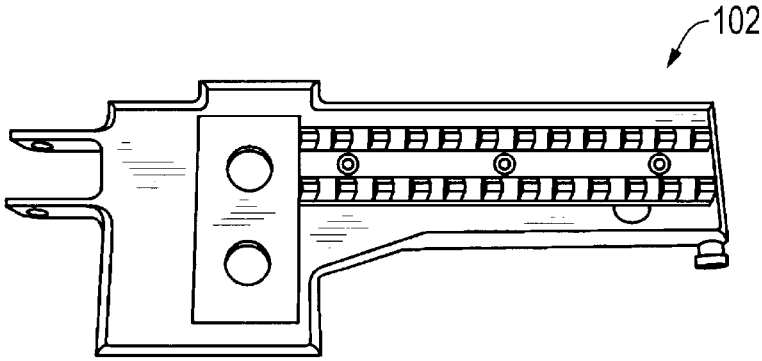
FIG. 19 is a top view illustrating an embodiment of a top cover of the ammunition belt feeding assembly depicted in FIG. 18.

As mentioned above in reference to FIG. 2E, moving the bolt 34 and the bolt carrier 36 between the open position O and the closed position C includes rotating the bolt 34 for unlocking and locking, respectively, the lugs of the bolt 34 from corresponding lugs of the barrel extension. FIGS. 11–13 show an embodiment of a mechanism for rotating lugs 34*b* of the bolt 34 between the unlocked position U' and the locked position L'. A cam pin 90 is attached to the bolt 34. The cam pin 90 is positioned in a cam pin hole 34*c* of the bolt 34, FIG. 13. The firing pin 32 extends through a firing pin hole 34*d* of the bolt 34 and a firing pin hole 90*a* of the cam pin 90. The cam pin 90 is captured in a cam slot 92 of the bolt carrier 36, FIGS. 11 and 12. When the bolt 34 is rotated such that the lugs 34*b,* FIG. 11, of the bolt 34 are unlocked from the lugs of the barrel extension, the cam pin 90 is positioned in a first region 92*a* of the cam slot 92. When the lugs 34*b* are unlocked from the lugs of the barrel extension, a retaining arm 94 is engaged with the cam pin 90 for retaining the cam pin 90 in the first region 92*a* of the cam slot 92. When the bolt 34 is moved toward the closed position and the bolt 34 engages the barrel extension, a ramp 94*a* of the retaining member 94, FIG. 11, engages a stationary ramp, thereby pivoting the retaining member 94 for allowing the cam pin 90 to move into a second region 92*b* of the cam slot 92. A feed tray 96 is a suitable stationary component to which the stationary ramp may be attached. When the cam pin 90 is in the second region 92*b* of the cam slot 92, the lugs 34*b* of the bolt 34 are in the locked position relative to the lugs of the barrel extension.

Another embodiment of a mechanism for rotating the lugs 34*b* of the bolt 34 between the unlocked position and the locked position is depicted in FIGS. 14–17. In this embodiment, the cam pin 90 extends through the cam pin slot 92 and into the bolt carrier lug channel 42*b* of the upper receiver body 42. In this manner, the cam pin 90 is constrained to follow a path defined by the bolt carrier lug channel 42*b*. When the bolt 34 is in the unlocked position U', FIGS. 14 and 15, the cam pin 90 is positioned in the first region 92*a* of the cam slot 92 and is free to travel in the forward and rearward directions along the length of the bolt carrier lug channel 42*b*. When the face 34*a* of the bolt 34 contacts the barrel extension, the bolt carrier 36 continues its forward movement. The continued forward movement of the bolt carrier 36 results in the cam pin 90 rotating in the cam slot 92 to the second region of the cam pin slot 92*b*, locking the lugs 34*b* of the bolt 34 relative to the lugs of the barrel extension. The bolt 34 is now in the locked position L'. A relief 42*c* is formed adjacent to the bolt carrier lug channel 42*b* for receiving the cam pin 90 when the bolt 34 is in the locked position L'. The bolt carrier lug 36*a* has a sufficient length such that it cannot rotate into the relief 42*c*. A bolt carrier assembly comprises the bolt 34 and the bolt carrier 36.

Figure 20:
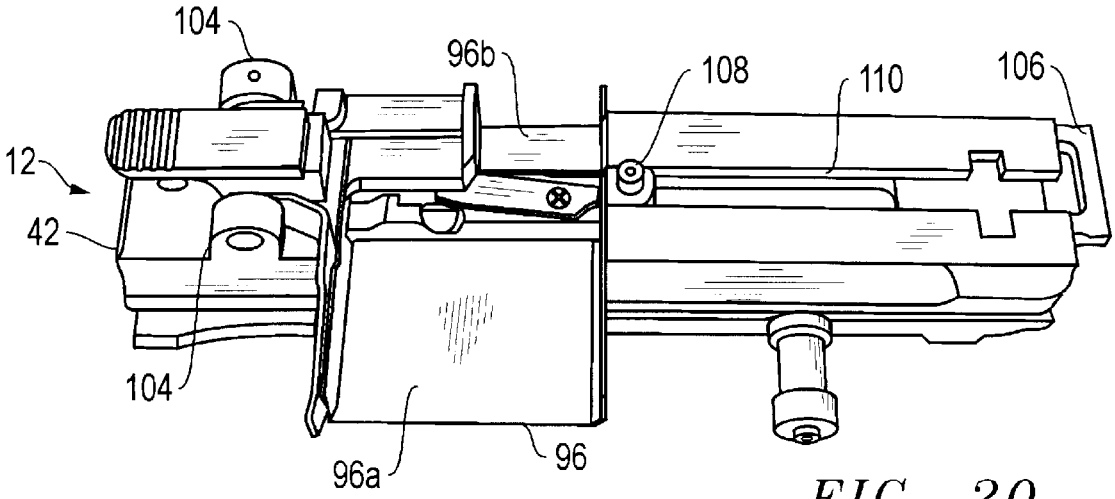
FIG. 20 is a perspective view illustrating an embodiment of a feed tray of the ammunition belt feeding assembly depicted in FIG. 18.

Referring to FIGS. 18–25, an ammunition belt feeding assembly 100 is mounted on the upper receiver body 42 of the upper receiver assembly 12. The ammunition belt feeding assembly 100 and the upper receiver assembly 12 comprise a belt feed receiver system. The ammunition belt feeding assembly 100 includes a top cover 102 mounted adjacent to the feed tray 96. The top cover 102 and the feed tray 96 are pivotally attached to the upper receiver body 42 through a plurality of bosses 104. A latch mechanism releasably engages a mounting bracket 106, FIG. 20, that is attached to the upper receiver body 42. The feed tray 96 includes a belt channel 96*a* and a link ejection channel 96*b*. A feed pin 108, FIG. 20, is attached to the bolt carrier 36 and extends through a feed pin channel 110 in the upper receiver body 42. The feed pin 108 moves in unison with the bolt carrier 36 along the feed pin channel 110.

Figure 21A:
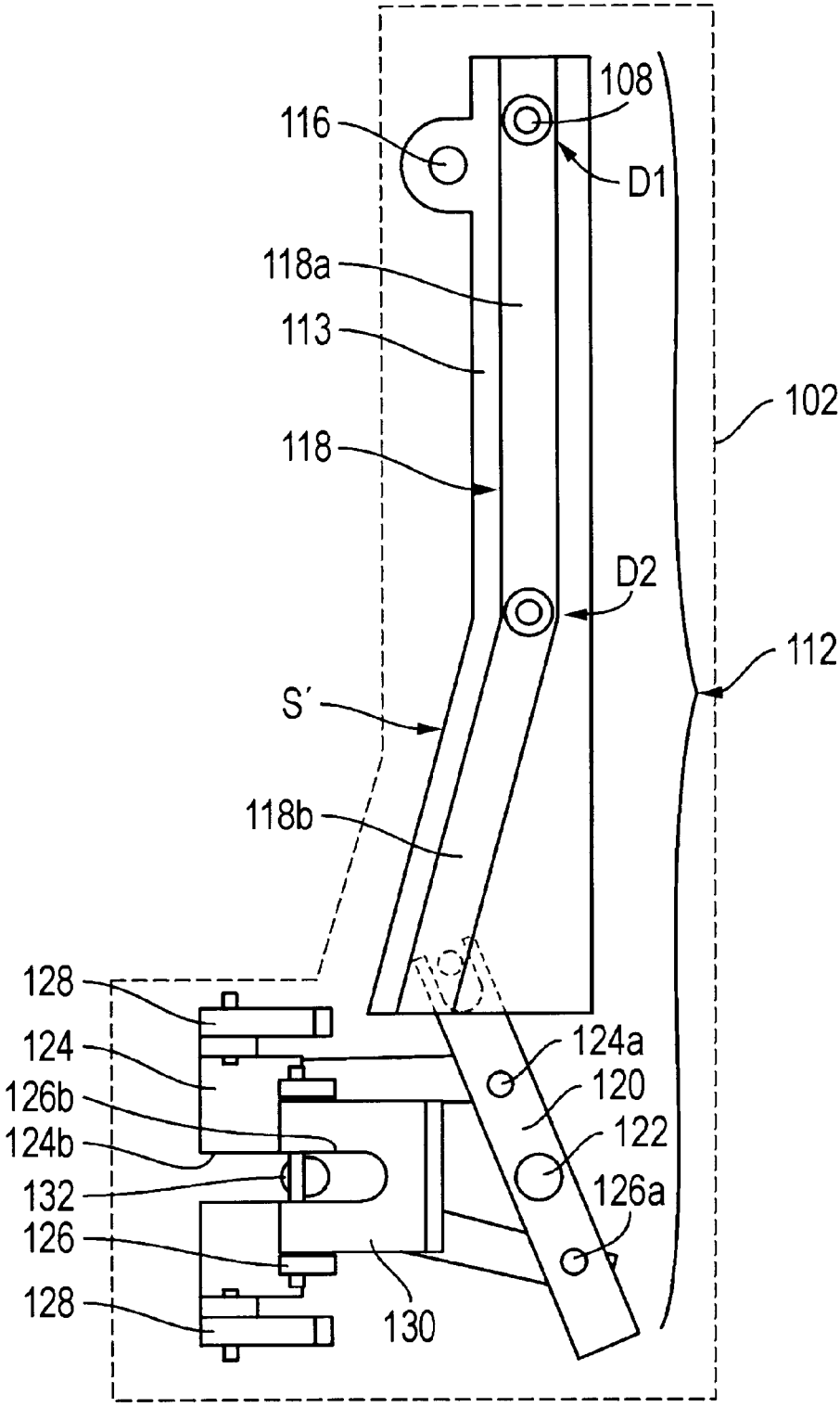
FIGS. 21A and 21B are diagrammatic views illustrating an embodiment of a lever-type ammunition belt feeding mechanism with a cam lever in a static position and a displaced position, respectively.
Figure 22:
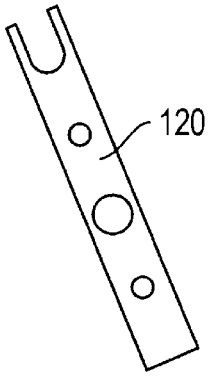
FIG. 22 is a plan view illustrating an embodiment of a feed link of the ammunition belt feeding mechanism depicted in FIGS. 21A and 21B.
Figure 21B:
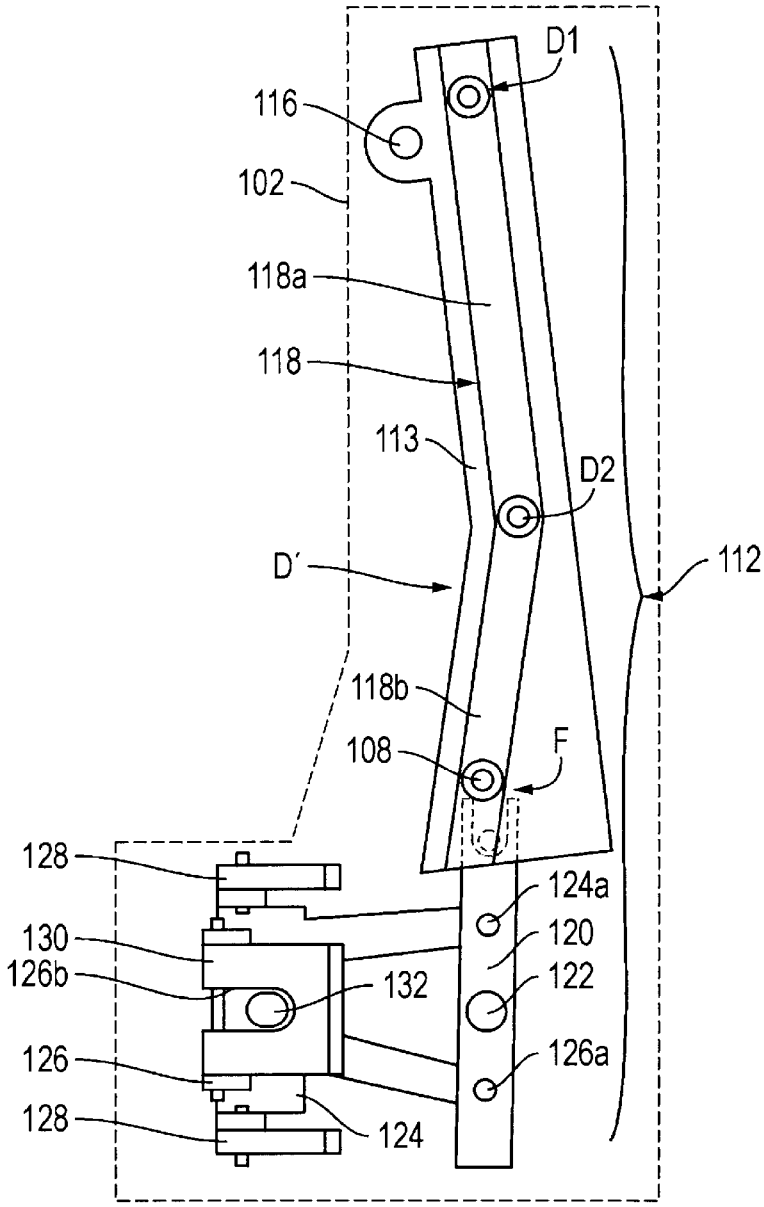
Figure 23:
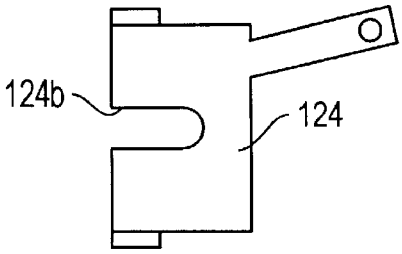
FIG. 23 is a plan view illustrating an embodiment of a first slide member of the ammunition belt feeding mechanism depicted in FIGS. 21A and 21B.
Figure 24:
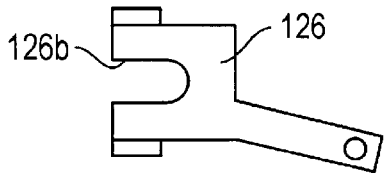
FIG. 24 is a plan view illustrating an embodiment of a second slide member of the ammunition belt feeding mechanism depicted in FIGS. 21A and 21B.

The ammunition belt feeding assembly 100 includes a two-stage cam-lever type ammunition belt feeding mechanism 112, FIGS. 21A–21B, attached to the top cover 102. It is contemplated that other types of cam-lever type ammunition belt feeding mechanisms, such as a single-stage cam-lever type, may be implemented with the upper receiver assembly 12 disclosed herein. It is beneficial for a cam-lever type ammunition belt feeding mechanism to be configured to limit adverse affects associated with acceleration and deceleration of the ammunition belt 114.

Referring to FIGS. 21–25, a cam lever 113 is pivotally attached to the top cover 102 at a pivot pin 116. The cam lever 113 includes a cam lever slot 118 having a dwell region 118*a* and a feed region 118*b*. The feed pin 108 is received in the cam lever slot 118. The cam lever 118 is engaged with a feed link 120 for pivoting the feed link 120 about a pivot pin 122. A first slide member 124 and a second slide member 126 are attached to the feed link 120 at respective feed link pins 124*a*, 126*a*. Primary feed pawls 128 are pivotally attached to the first slide member 124 and a secondary feed pawl 130 is pivotally attached to the second slide member 126. The first slide member 124 and the second slide member 126 include respective guide slots 124*b*, 126*b*. A guide pin 132 is attached to the top cover 102 and engages the first and the second slide members 124, 126 at the respective guide slots 124*b*, 126*b*.

Still referring to FIGS. 21–25, the ammunition belt feeding mechanism 112 operates in two distinct phases and feeds an ammunition belt 114 through the belt channel 96*a* towards the link ejection channel 96*b*. When the bolt and bolt carrier begins their forward travel toward the closed position, the feed pin 108 moves in a dwell region 118*a* of the cam lever slot 118 from a first dwell position D1 to a second dwell position D2, FIG. 21A. The operation and travel of the bolt and carrier are discussed above. The feed pin 108 is in the dwell region 118*a* of the cam lever slot 118 during a first portion of the forward travel of the bolt and the bolt carrier. While the feed pin 108 is in the dwell region 118*a* of the cam lever slot 118, the first and the second slide members 124, 126 are stationary, FIGS. 25A and 25B. Thus, the primary and the secondary feed pawls 128, 130 remain stationary while the feed pin 108 is in the dwell region 118*a* of the cam lever slot 118. As depicted in FIGS. 25A and 25B, a first round 114*a* at a chambering position C1 is chambered while the feed pin 108 is in the dwell region 118*a* of the cam lever slot 118. The first round 114*a* is now in a chambered position C2, as depicted in FIG. 25B, ready for being fired.

During the second portion of the forward travel of the bolt and the bolt carrier, the feed pin 108 reaches the feed region 118*b* of the cam lever slot 118 and travels from the second dwell position D2 to a feed position F, FIG. 21B. As a result of the feed region 118*b* being skewed with respect to the dwell region 118*a*, the cam lever 113 pivots from a static position S', FIG. 21A, to a displaced position D', FIG. 21B, as the feed pin 108 travels from the second dwell position D2 to the feed position F. The pivoting action of the cam lever 113 pivots the feed link 120. Accordingly, because the first and the second slide members 124, 126 are pinned to the feed link 120 on opposing sides of the pivot pin 122, the primary feed pawls 128 move towards the chambering position C1 and the secondary feed pawl 130 moves away from the chambering position C1, FIGS. 25C and 25D.

During movement towards the chambering position C1, the primary feed pawls 128 advance the second round 114*b* towards the chambering position C1 and into engagement with a cartridge follower 134. The cartridge follower 134, FIG. 25D, exerts a downward force on the cartridge of the second round 114*b*, biasing the second round 114*b* towards the chambered position C2. During movement away from the chambering position C1, the secondary feed pawl 130 ratchets over the cartridge of the second round 114*b*, FIG. 25C. In this manner, when the feed pin 108 reached the feed position F, the second round 114*b* is advanced towards the chambering position C1 and all of the feed pawls 128, 130 are positioned between the second round 114*b* and a third round 114*c*, FIG. 25D.

Figure 25A:
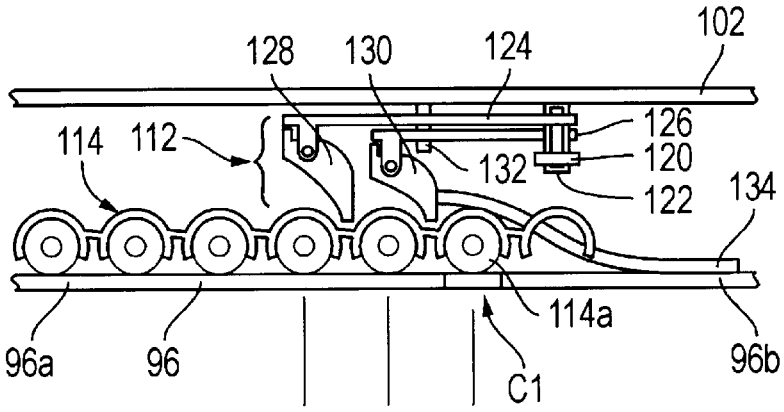
FIGS. 25A—25E are diagrammatic views illustrating an embodiment of an operational cycle of the ammunition belt feeding mechanism depicted in FIGS. 21A and 21B.
Figure 25B:
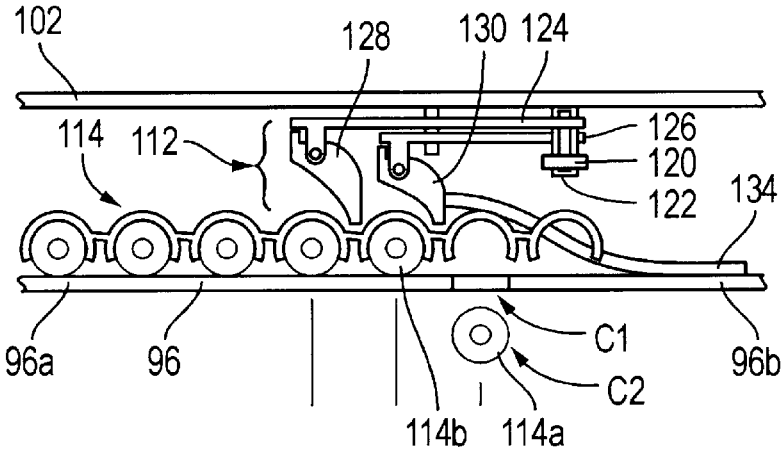
Figure 25C:
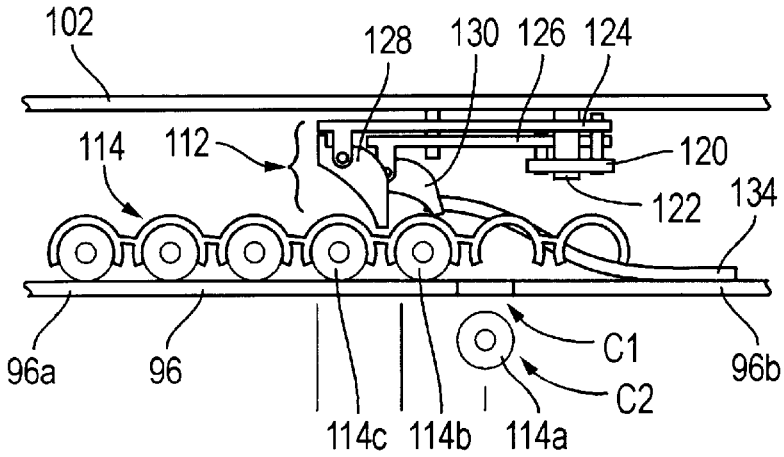
Figure 25D:
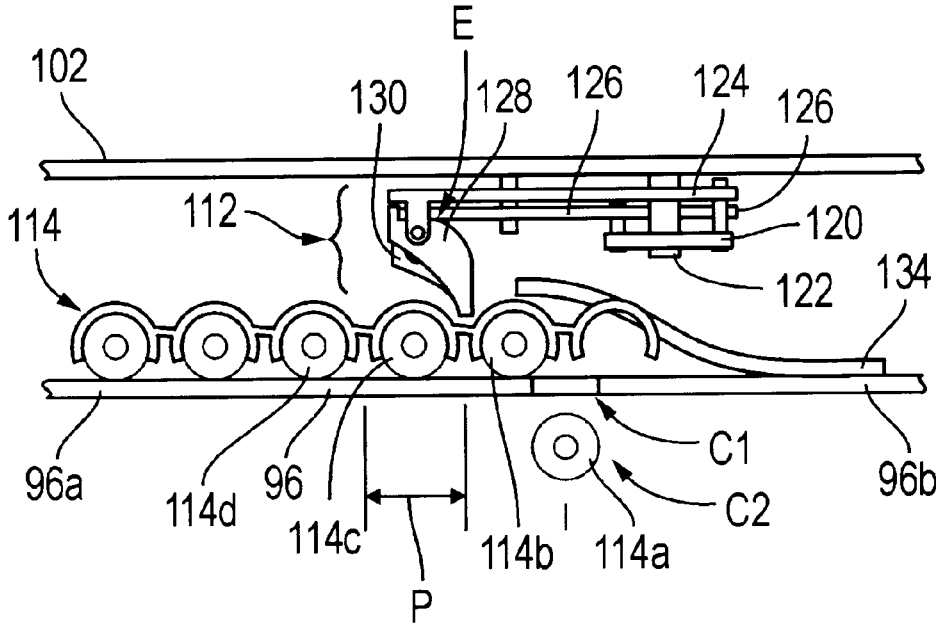
Figure 25E:
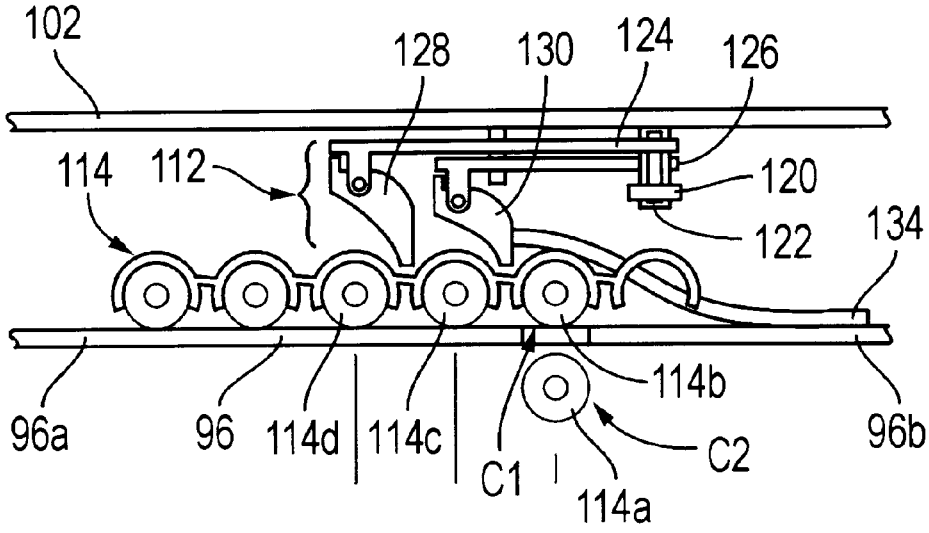

The primary and the secondary feed pawls 128, 130 may be biased to an engagement position E, FIG. 25D, by respective springs, by gravity, or any other suitable means for being automatically returned to the engagement position E after being ratcheted over a cartridge. The travel of the feed pin 108 from the second dwell position D2 to the feed position F results in the second round 114*b* being advanced approximately a first half of a pitch P of the ammunition belt 114. The bolt attains its closed position when the feed pin 108 reaches the feed position F.

After the first round 114*a* is fired, the bolt and the bolt carrier travel rearward towards the open position. The operation and travel of the bolt is discussed above. Accordingly, the feed pin 108 travels from the feed position F towards the second dwell position D2. As the feed pin 108 travels from the feed position F toward the second dwell position D2, the cam lever 113 pivots from the displaced position D' to the static position S'. As the feed pin 108 travels from the displaced position D' to the static position S', the primary feed pawls 128 move away from the chambering position C1 and the secondary feed pawl 130 moves towards the chambering position C1, FIGS. 25D and 25E.

During movement towards the chambering position C1, the secondary feed pawl 130 advance the second round 114*b* to the chambering position C1. As the secondary feed pawl 130 advances the second round 114*b* towards the chambering position C1, the cartridge follower 134 exerts additional force on the cartridge of the second round 114*b*, further biasing the second round 114*b* towards the chambered position C2. During movement away from the chambering position C1, the primary feed pawls 128 ratchet over the cartridge of the third round 114*c*. The second round 114*b* is now positioned at the chambering position C1, FIG. 25E. The secondary feed pawl 130 is now positioned between the second round 114*b* and the third round 114*c*. The primary feed pawls 128 are now positioned between the third round 114*c* and a fourth round 114*d*. The travel of the feed pin 108 from the feed position F to the second dwell position D2 results in the second round 114*b* being advanced a second half of the pitch P of the ammunition belt 114. The feed pawls 128, 130 do not move as the feed pin 108 travels from the second dwell position D2 back to the first dwell position D1.

Figure 26:
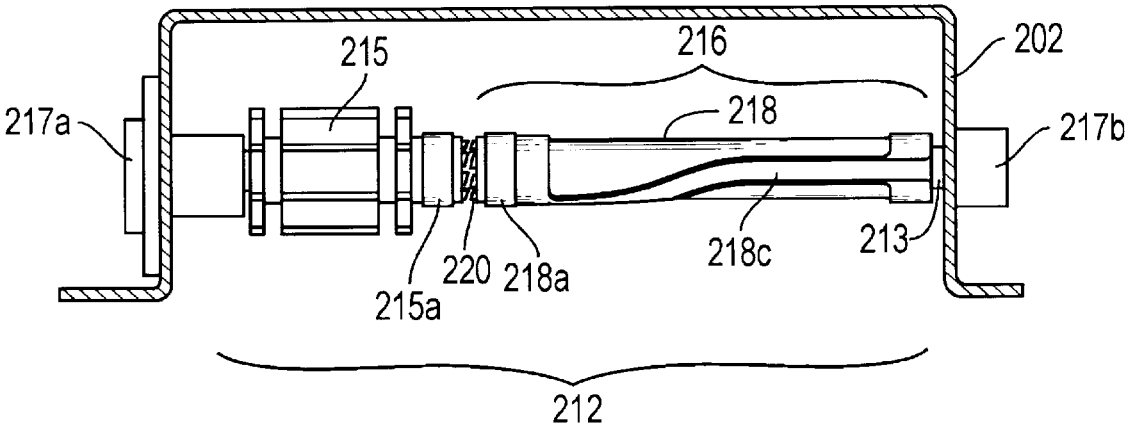
FIG. 26 is a diagrammatic view illustrating an embodiment of a sprocket-type ammunition belt feeding mechanism.
Figure 27:
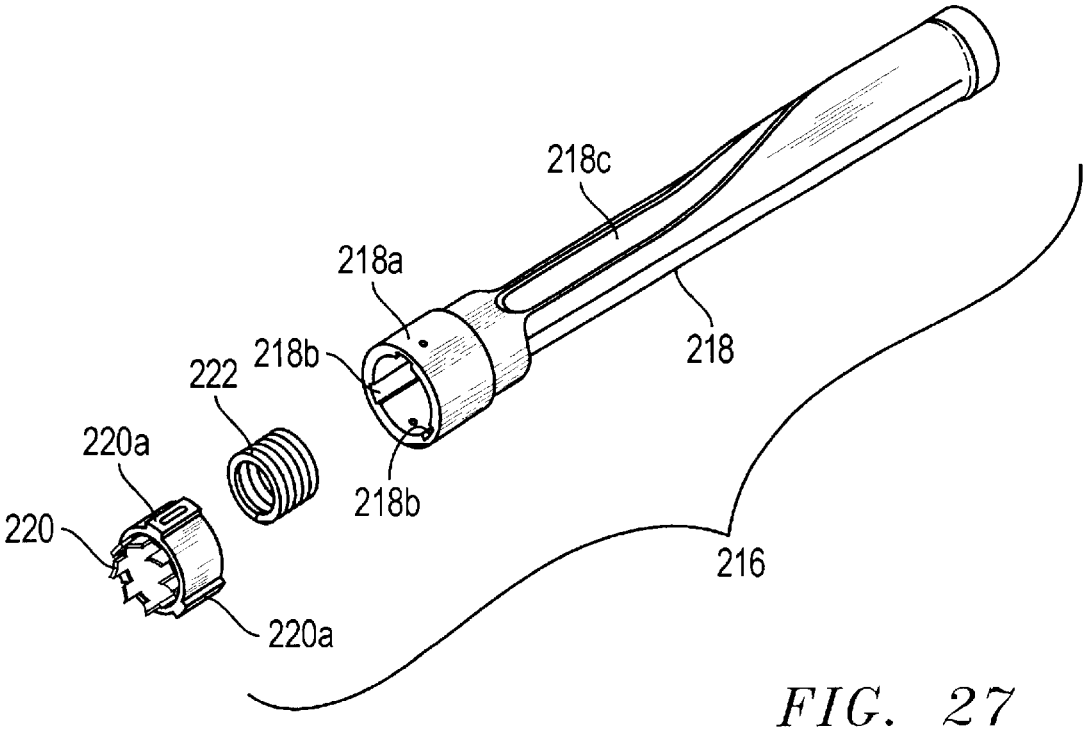
FIG. 27 is an exploded perspective view illustrating an embodiment of a drive shaft assembly of the sprocket-type ammunition belt feeding mechanism depicted in FIG. 26.

Referring to FIGS. 26–28, an embodiment of a sprocket type ammunition belt feeding mechanism 212 includes a feed sprocket 215 and a drive shaft assembly 216 coupled to the feed sprocket 215. As depicted in FIG. 26, a mounting shaft 213 extends through the feed sprocket 215 and drive shaft assembly 216, permitting the feed sprocket 215 and the drive shaft assembly 216 to rotate relative to a top cover 202 of an ammunition belt feeding assembly. The mounting shaft 213 is attached to the top cover 202 via a first and a second mounting bracket 217*a*, 217*b*. At least one of the mounting brackets 217*a*, 217*b* is removable from the top cover 202 for permitting the ammunition belt feeding mechanism 212 to be detached from the top cover 202.

In an alternated embodiment (not shown), the feed sprocket 215 and the drive shaft assembly 216 are mounted on a common axle shaft. The common axle shaft extends through the feed assembly and top cover ends. The axle shaft is secured by a cross-pin through the cover and radius of the axle shaft on one end of the cover.

The drive shaft assembly 216, FIGS. 26 and 27, includes a drive shaft 218 and a drive sleeve 220 mounted in a counter-bored end 218*a* of the drive shaft 218. The feed sprocket 215 includes a drive hub 215*a* that is fixedly attached to the feed sprocket 215 such that the feed sprocket 215 is precluded from rotating relative to the drive hub 215*a*. The drive sleeve 220 includes a plurality of ribs 220*a* thereon that mate with corresponding grooves 218*b* of the drive shaft 218 such that the drive sleeve 220 is precluded from rotating relative to the drive shaft 218. A spring 222, FIG. 27, is mounted between the drive sleeve 220 and the drive shaft 218 for biasing the drive sleeve 220 into engagement with the drive hub 215*a* of the feed sprocket 215, FIG. 26. The drive sleeve 220 and the drive hub 215*a* have mating tapered teeth. Accordingly, the drive shaft 218 can rotate relative to the feed sprocket 215 in only one direction.

Figure 28A:
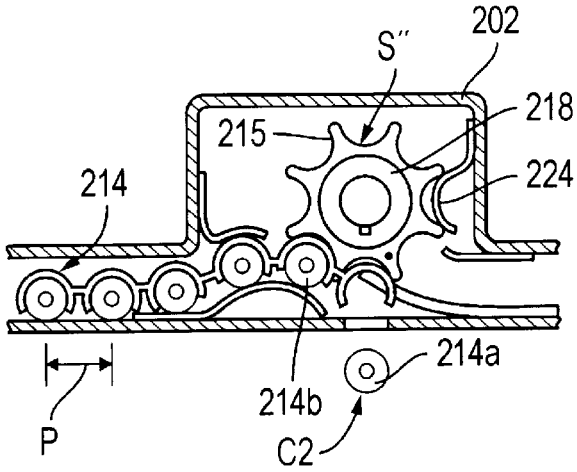
FIGS. 28A–28C are diagrammatic views illustrating an embodiment of an operational cycle of the ammunition belt feeding mechanism depicted in FIG. 26.

An operational cycle of the ammunition belt feeding mechanism 212 begins with a first round 214*a* being stripped from the ammunition belt 214 at the chambering position C1 by the bolt and chambered into the firing chamber, FIG. 28A. The first round 214*a* is now at the chambered position C2. After the first round 214*a* is fired, the bolt and bolt carrier travel from the closed position toward the open position. The drive shaft 218 includes a spiral drive slot 218*c* that receives the feed pin of the bolt carrier (discussed above). The profile of the drive slot 218*c* may be configured for minimize adverse affects associated with acceleration and deceleration of the ammunition belt 214.

Figure 28B:
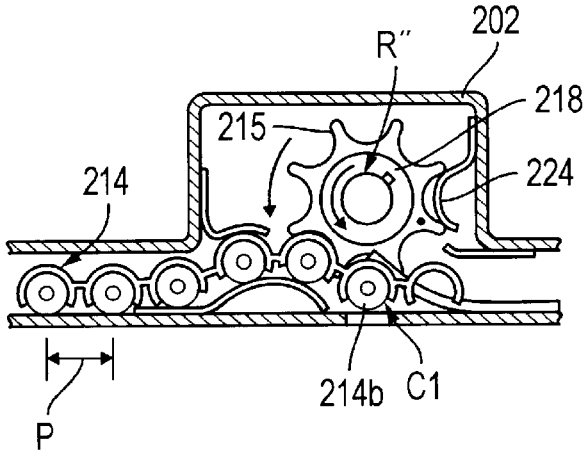
Figure 28C:
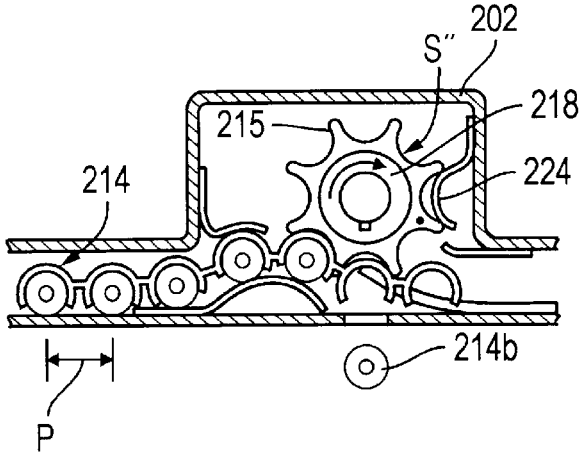

As the bolt carrier travels towards the open position, the feed pin travels in the drive slot 218*c* of the drive shaft 218, rotating the drive shaft 218 and the feed sprocket 215 from the static position S", FIG. 28A, to the rotated position R", FIG. 28B. The profile of the drive slot 218*c* is configured for rotating the drive shaft 218 through an angular displacement corresponding to the pitch P of the ammunition belt 214. Accordingly, a second round 214*b* is advanced to the chambering position C1 during rotation of the drive shaft 218 from the static position S" to the rotated position R". The cartridge of the first round 214*a* is withdrawn from the firing chamber and is ejected from the firearm as the bolt carrier travels from the closed position towards the open position.

An action spring (discussed above) arrests the travel of the bolt carrier toward the open position and urges the bolt carrier towards the closed position. As the bolt carrier travels from the open position toward the closed position, the drive shaft 218 rotates from the rotated position R" back to the static position S", FIG. 28C. An anti-reverse member 224 is engaged with the feed sprocket 215. The anti-reverse member 224 provides a retention force on the feed sprocket 215, holding the feed sprocket 215 stationary while the drive shaft 218 rotates back to the static position S".

In the preceding detailed description, reference has been made to the accompanying drawings which form a part hereof, and in which are depicted by way of illustration specific embodiments in which the invention may be practiced. These embodiments, and certain variants thereof, have been described in sufficient detail to enable those skilled in the art to practice the invention. It is to be understood that other suitable embodiments may be utilized and that logical, mechanical, chemical and electrical changes may be made without departing from the spirit or scope of the invention. For example, functional blocks depicted in the figures could be further combined or divided in any manner without departing from the spirit or scope of the invention. To avoid unnecessary detail, the description omits certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A method of actuating a bolt carrier group of a firearm, comprising:

pressurizing a bore of a piston tube in response to firing a round of ammunition, wherein pressurizing the bore of the piston tube includes routing a combustion gas into the bore of the piston tube and through an adjustable pressure regulator; and moving a tappet assembly mounted on the piston tube from a static position toward a displaced position in response to pressurizing the bore of the piston tube, wherein the tappet assembly is engaged with a bolt carrier of the bolt carrier group and is coupled to an operating rod that is at least partially disposed within the piston tube.

2. The method of claim 1 wherein moving the tappet assembly includes translating a yoke of the tappet assembly along a longitudinal axis of a piston tube.

3. The method of claim 1 wherein the operating rod is disposed completely within the piston tube.

4. The method of claim 1 wherein the adjustable pressure regulator is adjustable between a plurality of pressure regulating positions.

5. The method of claim 1 wherein: moving the tappet assembly includes exposing a face of a piston mounted in the piston tube to the combustion gas; and the piston is coupled to the operating rod.

6. A method of actuating a bolt carrier group of a firearm, comprising:

pressurizing a bore of a piston tube in response to firing a round of ammunition, wherein pressurizing the bore of the piston tube includes routing a combustion gas into the bore of the piston tube and through an adjustable pressure regulator; and exposing a face of a piston mounted in the piston tube to the combustion gas whereby a force is generated for moving a tappet assembly mounted on the piston tube along a longitudinal axis of a piston tube from a static position toward a displaced position in response to pressurizing the bore of the piston tube, wherein the tappet assembly is engaged with a bolt carrier of the bolt carrier group.

7. An apparatus adapted for actuating a bolt carrier group of a receiver assembly, comprising:

a piston tube attached to a receiver assembly;

an operating rod disposed in a bore of the piston tube;

a piston engaged with a first end of the operating rod;

a tappet assembly movably mounted on the piston tube and engaged with a bolt carrier; and an adjustable pressure regulator coupled to the piston tube.

8. The apparatus of claim 7 wherein the operating rod moves from a static position to a displaced position when a combustion gas is exposed to a face of the piston, the tappet assembly moving substantially in unison with the operating rod.

9. The apparatus of claim 7 wherein the tappet assembly includes a yoke movably mounted on the piston tube and a tappet rod attached to the yoke, the yoke being attached to the operating rod and the tappet rod being engaged with the bolt carrier.

10. The apparatus of claim 9 wherein the bolt carrier includes a bolt carrier lug disposed in a bolt carrier lug channel of an upper receiver body and wherein the tappet rod is engaged with the bolt carrier lug.

11. The apparatus of claim 7 wherein the adjustable pressure regulator is adjustable between a plurality of pressure regulating positions.

12. An apparatus adapted for actuating a bolt carrier group of a receiver assembly, comprising:

a piston tube attached to a receiver assembly;

an operating rod disposed in a bore of the piston tube;

a piston engaged with a first end of the operating rod, wherein the operating rod moves from a static position to a displaced position when a combustion gas is exposed to a face of the piston;

a bolt carrier including a bolt carrier lug disposed in a bolt carrier lug channel of an upper receiver body;

a tappet rod engaged with the bolt carrier lug, wherein the tappet rod moves substantially in unison with the operating rod;

a yoke attached to the tappet rod and to the operating rod, wherein the yoke is mounted movably on the piston tube; and an adjustable pressure regulator coupled to the piston tube for regulating discharge of the combustion gas therethrough.

* * * * *